US009669848B2

(12) United States Patent
Creighton et al.

(10) Patent No.: US 9,669,848 B2
(45) Date of Patent: Jun. 6, 2017

(54) ENERGY ABSORPTION/COUPLING SYSTEM FOR A RAILCAR AND RELATED METHOD FOR COUPLING RAILCARS TO EACH OTHER

(71) Applicant: Trinity North American Freight Car, Inc., Dallas, TX (US)

(72) Inventors: George S. Creighton, Pompano Beach, FL (US); Aubra D. McKisic, Flower Mound, TX (US); Donald E. Wilt, Batavia, IL (US); Robert J. Pokorski, Saint Charles, IL (US); Keith A. Salis, Clare, IL (US); Erich A. Schoedl, Yorkville, IL (US)

(73) Assignee: Trinity North American Freight Car, Inc., Dallas, TX (US)

( * ) Notice: Subject to any disclaimer, the term of this patent is extended or adjusted under 35 U.S.C. 154(b) by 351 days.

(21) Appl. No.: 14/467,885

(22) Filed: Aug. 25, 2014

(65) Prior Publication Data

US 2015/0014267 A1 Jan. 15, 2015

Related U.S. Application Data

(63) Continuation-in-part of application No. 13/063,426, filed on Mar. 10, 2011, now Pat. No. 9,056,618.

(51) Int. Cl.
*B61G 9/10* (2006.01)
*B61G 9/06* (2006.01)
(Continued)

(52) U.S. Cl.
CPC ..... *B61G 9/10* (2013.01); *B61F 1/02* (2013.01); *B61F 1/10* (2013.01); *B61G 3/04* (2013.01); *B61G 11/00* (2013.01); *B61G 11/16* (2013.01)

(58) Field of Classification Search
CPC ... B61G 3/04; B61G 9/04; B61G 9/06; B61G 9/10; B61G 11/08
(Continued)

(56) References Cited

U.S. PATENT DOCUMENTS 3,491,898 A * 1/1970 Suckow ..... B61G 9/06 213/22
3,854,599 A 12/1974 Day et al.
(Continued)

OTHER PUBLICATIONS

International Searching Authority; International Search Report regarding International PCT patent application PCT/US2015/46546; Nov. 27, 2015; two (2) pages.
(Continued)

*Primary Examiner* — Zachary Kuhfuss
(74) *Attorney, Agent, or Firm* — Baker Botts, LLP

(57) ABSTRACT

An energy absorption/coupling system for a railcar including a draft assembly provided toward opposed ends of a centersill on the railcar. Each draft assembly includes a coupler and a draft gear assembly disposed in longitudinally disposed and operable relation relative to each other. The coupler is configured to allow at least 4.5 inches of travel in a single longitudinal direction during operation of the coupler. The draft gear assembly of each draft assembly is configured to consistently and repeatedly withstand up to about 110,000 ft-lbs. of energy imparted to the energy absorption/coupling system at a force level not to exceed 900,000 lbs. over a range of travel of a wedge member in an inward axial direction relative to the housing of at least 4.5 inches. With the present invention disclosure, high level impact forces between rail cars can be absorbed and dissipated while maintaining an overall length of the railcar constant and unchanged. A method for releasably coupling two railcars to each other is also disclosed.

23 Claims, 19 Drawing Sheets

(51) Int. Cl.

| | |
|---|---|
| ***B61G 9/04*** | (2006.01) |
| ***B61G 3/04*** | (2006.01) |
| ***B61G 11/00*** | (2006.01) |
| ***B61F 1/02*** | (2006.01) |
| ***B61F 1/10*** | (2006.01) |
| ***B61G 11/16*** | (2006.01) |

(58) Field of Classification Search
USPC ..... 213/31, 32 C, 65
See application file for complete search history.

(56) References Cited

U.S. PATENT DOCUMENTS

| | | | |
|---|---|---|---|
| 4,198,037 | A | 4/1980 | Anderson |
| 4,576,295 | A | 3/1986 | Carlstedt |
| 4,960,215 | A | 10/1990 | Carlstedt |
| 4,984,696 | A | 1/1991 | Altherr |
| 5,104,101 | A | 4/1992 | Anderson et al. |
| 5,351,844 | A | 10/1994 | Carlstedt |
| 6,148,733 | A | 11/2000 | Gagliardino |
| 6,478,173 | B2 | 11/2002 | Carlstedt |
| 6,488,162 | B1 | 12/2002 | Carlstedt |
| 6,520,360 | B1 | 2/2003 | Withall et al. |
| 6,792,871 | B2 | 9/2004 | O'Donnell et al. |
| 6,796,448 | B1 | 9/2004 | Wilt et al. |
| 6,862,999 | B2 | 3/2005 | O'Donnell et al. |
| 6,877,623 | B2 | 4/2005 | Salis |
| 7,044,061 | B2 | 5/2006 | O'Donnell et al. |
| 7,624,884 | B2 | 12/2009 | Palermo et al. |
| 9,056,618 | B2 * | 6/2015 | Gagliardino ..... B61G 3/04 |
| 2002/0070189 | A1 | 6/2002 | Barker et al. |
| 2008/0128377 | A1 | 6/2008 | Mautino et al. |
| 2010/0059470 | A1 | 3/2010 | Carlstedt |
| 2016/0052530 | A1 | 2/2016 | Wilt |

OTHER PUBLICATIONS

International Searching Authority; Written Report of the International Searching Authority regarding PCT patent application PCT/US2015/46546; Nov. 27, 2015: ten (10) pages.

Office Action issued by the Canadian Intellectual Property Office for Application No. 2,736,509—Feb. 6, 2017.

* cited by examiner

ENERGY ABSORPTION/COUPLING SYSTEM FOR A RAILCAR AND RELATED METHOD FOR COUPLING RAILCARS TO EACH OTHER

RELATED APPLICATION

This application is a Continuation-In-Part of U.S. patent application Ser. No. 13/063,426.

FIELD OF THE INVENTION DISCLOSURE

This invention disclosure generally relates to railcars and, more specifically, to an energy absorption/coupling system for railcars and a related method for coupling railcars to each other.

BACKGROUND

As railroads push to increase car capacity to handle the increasing demands on the transportation network, freight car designers/builders have been stepping up to the challenge. With the overall train lengths limited by system constraints such as passing siding lengths, the challenge has been how to achieve more railcar capacity in the same or shorter lengths of freight cars and trains. Freight car designers/builders have heretofore met this challenge by pushing the top and bottom of the defined clearance line envelopes to the limits allowed by the Association of American Railroads (the "AAR"). Additionally, car designers/builders have utilized modern design tools to make freights car designs lighter in weight, while still meeting the AAR standard design loads whereby allowing each freight car to carry more lading while maintaining maximum allowable gross rail loads.

During the process of assembling or "making-up" a freight train, railcars are run into and collide with each other to couple them together. Since time is money, the speed at which the railcars are coupled has significantly increased. Moreover, and because of their increased capacity, the railcars are heavier than before. These two factors and others have resulted in increased damages to the railcars when they collide and, frequently, to the lading carried within such railcars and to the railcar itself.

As railroad car designer/builders have reduced the weight of their designs, they have also identified a need to protect the integrity of the railcar due to excessive longitudinal loads being placed thereon, especially as the railcars are coupled to each other. Whereas, such longitudinal loads frequently exceed the design loads set by the AAR. Providing an energy absorption/coupling system at opposed ends of each railcar has long been known in the art. Such a system typically includes a draft assembly comprised of a coupler for releasably attaching two railcars to each other and a draft gear assembly arranged in operable combination with each coupler for absorbing, dissipating and returning energy imparted thereto during make-up of the train consist and during operation of the railcar.

The draft gear assembly is typically disposed within a pocket defined by a centersill on the railcar and has an operative length of travel in one direction of movement of about 3.5 inches before solid stops limit the travel and no more energy can be absorbed by the draft gear. Over this limited distance, the energy of the moving railcar must be absorbed so as to reduce the impact forces and resulting damage to the adjacent railcar to be coupled thereto. Largely because of their increased coupling speeds and the increased weights of the loads being carried thereby, heretofore known energy absorption/coupling systems have been shown to be inadequate. As such, railcars are experiencing severe end-impacts that can cause a complete collapse of the end of the car—resulting in large repair costs—coupled with damage to the lading—resulting in significantly higher insurance premiums.

Increasing the travel of the draft gear assembly would advantageously allow more energy to be absorbed. The challenge of increasing the travel of the draft gear assembly is, however, complicated. Increasing the travel of the draft gear assembly has heretofore meant increasing the length of the railcar to accomplish such a beneficial result. The length of a railroad car, however, is critical.

Passing sidings and loading facilitates often limit the number of railcars that can be joined to each other in one train. Lengthening each energy absorption/coupling system even by about 3 inches would add almost 50 feet to the cumulative or overall length of a 100 railcar train consist. This would result in the last railcar in such a 100 car consist no longer fitting on the siding and, thus, having to be left behind. As such, there would be at least a one percent (1%) loss in train efficiency. This is simply unacceptable. Accordingly, the concept of increasing the length of each energy absorption/coupling system can be accepted only in limited, special purpose applications.

Thus, there is a continuing need and desire for an energy absorbing/coupling system for a railcar which allows for increased travel over which the high level of energy from impact loads of colliding railcars can be absorbed, dissipated and returned while maintaining the length of the draft gear assembly housing constant with known housing designs along with a method for coupling two railcars to each other.

SUMMARY

In view of the above, and in accordance with one aspect of this invention disclosure, there is provided an energy absorbing/coupling system for a railcar including a draft assembly provided toward opposed ends of a centersill on the railcar, with each draft assembly including a coupler and a draft gear assembly disposed in longitudinally disposed and operable relation relative to each other. The coupler includes a head portion extending longitudinally from a shank portion. The coupler head portion longitudinally extends from an end of the centersill and includes: a knuckle for releasably connecting the coupler to a second railcar coupler on an adjacent railcar, a gathering face extending from a nose end and toward the shank portion for engaging a knuckle of the second railcar coupler on the adjacent railcar, and wherein the head portion further includes a horn portion with a back surface extending generally transverse to a longitudinal axis of the coupler and longitudinally disposed relative to the nose end such that the coupler is permitted at least 4.5 inches of travel in a single longitudinal direction during operation of the coupler. In one embodiment, the coupler permits 4.5 inches of travel in a "buff" direction and 4.5 inches of travel in a "draft" direction.

According to this aspect, the draft gear assembly includes: a hollow metal housing open at a first end and closed toward the second end thereof. The housing is configured to fit within a standard sized pocket defined by the centersill on the railcar. The housing defines a series of tapered longitudinally extended inner surfaces opening to and extending from the first end of the housing. A series of friction members are equally spaced about a longitudinal axis of the draft gear assembly toward the first end of the housing, with each friction member having axially spaced first and second ends and an outer surface extending between the ends. The outer surface on each friction member is operably associated with one of the tapered longitudinally extended inner surfaces on the housing so as to define a first angled friction sliding surface therebetween.

A wedge member is arranged for axial movement relative to the first end of the housing and to which the shank of the coupler applies an external force during operation of the railcar. The wedge member defines a series of outer tapered surfaces equally spaced about the longitudinal axis of the housing. Each outer tapered surface on the wedge member is operably associated with an inner surface on each friction member so as to define a second angled friction sliding surface therebetween and such that the wedge member produces a radially directed force against the friction members upon movement of the wedge member inwardly of the housing. A spring seat is arranged within the housing. One surface of the spring seat is arranged in operable engagement with the second end of each friction member.

A spring assembly is disposed in the housing between the closed end of the housing and a second surface of the spring seat for storing, dissipating and returning energy imparted to the draft gear assembly by the coupler. The spring assembly includes an axial stack of individual elastomeric springs. Advantageously, the spring assembly, in operable combination with the disposition of the first and second angled sliding surfaces of the draft gear assembly relative to the longitudinal axis of the draft gear assembly, consistently and repeatedly permits the energy absorbing/coupling system for the railcar to consistently and repeatedly withstand about 70,000 ft-lbs. to about 85,000 ft-lbs. of energy imparted to the draft gear assembly while not exceeding a force level of 600,000 lbs. over a range of travel of the wedge member in an inward axial direction relative to the housing approximating 3.5 inches.

In a preferred embodiment, a distance of approximating 10.75 inches separates the back surface of the horn portion from the nose end on the head portion. In one embodiment, the shank portion of the coupler defines a key slot having a length greater than approximately 8 inches. Moreover, the coupler head portion furthermore preferably includes a locklifter shelf disposed less than 2 inches above a bottom edge of the coupler.

The first angled friction sliding surface of the draft gear assembly is disposed at an angle ranging between about 1.5 degrees and about 5 degrees relative to the longitudinal axis of the draft gear assembly. Preferably, the first angled friction sliding surface of the draft gear assembly is disposed at an angle ranging between about 1.7 degrees and about 2 degrees relative to the longitudinal axis of the draft gear assembly. Preferably, the second angled friction sliding surface of the draft gear assembly is disposed at an angle ranging between about 32 degrees and about 45 degrees relative to the longitudinal axis of the draft gear assembly. In one form, the elastomeric pad of each individual elastomeric spring is formed from a polyester material having a Shore D hardness ranging between about 40 and 60. Preferably, the spring assembly of the draft gear assembly further includes a rigid separator plate disposed between two individual springs in the axial stack of elastomeric springs so as to create different dynamic elastic absorption characteristics on opposite sides of the separator plate whereby optimizing dynamic lost work opportunities during an impact event of the draft gear assembly.

According to another aspect of this invention disclosure there is provided an energy absorbing/coupling system for a railcar including a draft assembly provided toward opposed ends of a centersill on the railcar. Each draft assembly includes a coupler and a draft gear assembly disposed in longitudinally disposed and operable relation relative to each other. The coupler includes a head portion extending longitudinally from a shank portion. The head portion longitudinally extends from an end of the centersill and includes: a knuckle for releasably connecting the coupler to a second railcar coupler on an adjacent railcar, a gathering face extending from a nose end for engaging a knuckle of the second railcar coupler on the adjacent railcar, and a guard arm portion longitudinally extending from the nose end toward the shank portion. The head portion of the coupler is structured to permit at least 4.5 inches of travel of the shank portion in a single longitudinal direction during operation of the coupler.

According to this aspect, the draft gear assembly includes: a hollow metal housing open at a first end and closed toward the second end thereof. The draft gear assembly housing is configured to fit within a standard sized pocket defined by the centersill on the railcar. The housing defines a series of tapered longitudinally extended inner surfaces opening to and extending from the first end of the housing. A series of friction members are equally spaced about a longitudinal axis of the housing toward the first end of the housing. Each friction member has axially spaced first and second ends and an outer surface extending between the ends. The outer surface on each friction member is operably associated with one of the tapered longitudinally extended inner surfaces on the housing so as to define a first angled friction sliding surface therebetween.

A wedge member is arranged for axial movement relative to the first end of the housing and to which the shank of the coupler operably applies an external force during operation of the railcar. The wedge member defines a series of outer tapered surfaces equally spaced about the longitudinal axis of the housing. Each outer tapered surface on the wedge member is operably associated with an inner surface on each friction member so as to define a second angled friction sliding surface therebetween and such that the wedge member produces a radially directed force against the friction members upon movement of the wedge member inwardly of the housing. A spring seat is arranged within the housing. One surface of the spring seat is arranged in operable engagement with the second end of each friction member.

A spring assembly is disposed within and between the closed end of the housing and a second surface of the spring seat for storing, dissipating and returning energy imparted thereto, and wherein the spring assembly of the energy absorbing/coupling system is configured to function in operable combination with the disposition of said first and second angled sliding surfaces of said draft gear assembly such that said draft gear assembly consistently and repeatedly withstands about 110,000 ft-lbs. of energy imparted to the draft gear assembly at a force level not to exceed 900,000 lbs. over a range of travel of the wedge member in an inward axial direction relative to the housing of at least 4.5 inches. With the present invention disclosure, the high level impact forces between railcars can be advantageously absorbed and dissipated while maintaining the overall length of the railcar constant and unchanged.

In one form, a distance ranging between about 10.75 inches and 11 inches separates the back surface of the horn portion from the nose end on the head portion. Preferably, the coupler head portion further includes a locklifter shelf disposed approximately 2 inches above a bottom edge of the coupler. In a preferred embodiment, the shank portion of the coupler defines a closed ended key slot having a length greater than approximately 8 inches.

Preferably, the first angled friction sliding surface on the draft gear assembly is disposed at an angle ranging between about 1.5 degrees and about 5 degrees relative to the longitudinal axis of the draft gear assembly. In the preferred form, the second angled friction sliding surface is disposed at an angle ranging between about 32 degrees and about 45 degrees relative to the longitudinal axis of the draft gear assembly.

The spring assembly preferably includes an axial stack of individual elastomeric springs. Each spring includes an elastomeric pad having a generally rectangular shape, in plan, approximating the cross-sectional configuration of the hollow chamber defined by the housing whereby optimizing the capability of the spring assembly to store, dissipate and return energy imparted to the draft gear assembly by the coupler. The elastomeric pad of each individual elastomeric spring is preferably has a Shore D hardness ranging between about 40 and 60. Preferably, the spring assembly of the draft gear assembly further includes a rigid separator plate disposed between two individual springs in the axial stack of elastomeric springs so as to create different dynamic elastic absorption responses on opposite sides of the separator plate whereby optimizing dynamic lost work opportunities during an impact event of the draft gear assembly.

In another family of embodiments, there is provided an energy absorbing/coupling system for a railcar having a centersill defining a pocket. The energy absorbing/coupling system includes a pair of draft assemblies provided toward the ends of the centersill so as to provide a cumulative longitudinal distance greater than 8.5 inches of travel over which energy, imparted to the railcar, is absorbed while maintaining an overall length of the railcar constant. Each draft assembly includes a coupler and a draft gear assembly disposed in longitudinally disposed and operable relation relative to each other. The coupler includes a head portion extending longitudinally from a shank portion. The head portion of the coupler longitudinally extends from an end of the centersill and includes: a knuckle for releasably connecting the coupler to a second railcar coupler of an adjacent railcar, a nose portion and a gathering face extending from the nose portion for engaging a knuckle of the second railcar coupler on the adjacent railcar, a guard arm portion longitudinally extending from the nose portion toward the shank portion. In this embodiment, the coupler is configured to allow for at least 4.5 inches of travel in a single longitudinal direction during operation of the coupler.

In this embodiment, the draft gear assembly of each draft assembly includes: a hollow metal housing open at a first end and closed toward the second end thereof. The housing is configured to fit within the pocket defined by the centersill on the railcar. The housing defines a series of tapered longitudinally extended inner surfaces opening to and extending from the first end of the housing. A series of friction members are equally spaced about a longitudinal axis of the housing and are arranged toward the first end of the housing. Each friction member has axially spaced first and second ends and an outer surface extending between the ends. The outer surface on each friction member is operably associated with one of the tapered longitudinally extended inner surfaces on the housing so as to define a first angled friction sliding surface therebetween.

A wedge member is arranged for axial movements relative to the first end of the housing and is disposed such that the shank portion of the coupler operably applies an external force thereto during operation of the railcar. The wedge member defines a series of outer tapered surfaces equally spaced about the longitudinal axis of the housing. Each outer tapered surface on the wedge member is operably associated with an inner surface on each friction member so as to define a second angled friction sliding surface therebetween.

In operation, the wedge member produces a radially directed force against the friction members upon movement of the wedge member inwardly of the housing. A spring seat is arranged within the housing. One surface of the spring seat is arranged in operable engagement with the second end of each friction member.

A spring assembly is disposed in the housing between the closed end of the housing and a second surface of the spring seat for storing, dissipating and returning energy imparted to the draft gear assembly by the coupler. The spring assembly of each draft gear assembly operates in operable combination with the first and second angled surfaces on the draft gear assembly such that each draft gear assembly consistently and repeatedly withstands about 75,000 ft-lbs. to about 110,000 ft-lbs. of energy imparted thereto while not exceeding a force level of 900,000 lbs. over a range of travel of the coupler in an inward axial direction relative to the centersill of about 4.5 inches whereby permitting the draft assemblies provided toward the ends of the centersill to provide a cumulative longitudinal distance equal to about 9 inches of travel over which energy, imparted to the railcar, is absorbed while maintaining an overall length of the railcar constant and unchanged.

In this embodiment, a distance ranging between about 10.75 inches and 11 inches separates the back surface of the horn portion from the nose end on the head portion. Preferably, the coupler head portion further includes a locklifter shelf disposed approximately 2 inches above a bottom edge of the coupler. In one form, the shank portion defines a closed ended key slot having a length greater than approximately 8 inches.

Preferably, the first angled friction sliding surface on the draft gear assembly is disposed at an angle ranging between about 1.5 degrees and about 5 degrees relative to the longitudinal axis of the draft gear assembly. In one form, the second angled friction sliding surface is disposed at an angle ranging between about 32 degrees and about 45 degrees relative to the longitudinal axis of the draft gear assembly.

In one embodiment, the housing of each draft assembly has two pairs of joined and generally parallel walls extending from the closed end toward the open end of the housing such that the walls define a hollow chamber having a generally rectangular cross-sectional configuration, in plan, for a major portion of the length thereof and which opens to the open end of the housing. Preferably, the spring assembly includes an axial stack of individual elastomeric springs, with each elastomeric spring including an elastomeric pad having a generally rectangular shape, in plan, approximating the cross-sectional configuration of the hollow chamber defined by the housing whereby optimizing the capability of the spring assembly to store, dissipate and return energy imparted to the draft gear assembly by the coupler. In a preferred embodiment, the elastomeric pad of each individual elastomeric spring has a Shore D hardness ranging between about 40 and 60. In a preferred form, the spring assembly of the assembly further includes a separator plate disposed between two individual springs in said axial stack of elastomeric springs so as to create different dynamic elastic absorption reactions on opposite sides of the separator plate whereby optimizing dynamic lost work opportunities during an impact event of the draft gear assembly.

Yet another aspect of this invention disclosure involves a method for releasably coupling two railcars to each other. The method includes the steps of: providing each railcar with a pair of draft assemblies which operate in unison relative to each other so as to provide a cumulative longitudinal travel of about 9 inches over which energy imparted to the railcar is to be absorbed without having to increase the overall length of the railcar. Each draft assembly including a coupler and a draft gear assembly disposed in longitudinally disposed and operable relation relative to each other.

Each coupler has a head portion extending longitudinally from a shank portion. The head portion of the coupler includes: a knuckle for releasably connecting the coupler to a second railcar coupler of an adjacent railcar, a nose end and a gathering face extending from the nose end for engaging a knuckle of the second railcar coupler on the adjacent railcar, and wherein the coupler is configured to allow for at least 4.5 inches of travel in a single longitudinal direction during operation of the coupler.

The draft gear assembly of each draft assembly preferably has a hollow metal housing open at a first end and closed toward the second end thereof. The housing is configured to fit within the pocket defined by the centersill on the railcar. The housing defines a series of tapered longitudinally extended inner surfaces opening to and extending from the first end of the housing. A series of friction members are equally spaced about a longitudinal axis of the housing toward the first end of the housing. Each friction member has axially spaced first and second ends and an outer surface extending between the ends. The outer surface on each friction member is operably associated with one of the tapered longitudinally extended inner surfaces on the housing so as to define a first angled friction sliding surface therebetween.

A wedge member is arranged for axial movements relative to the first end of the housing. The wedge member defines a series of outer tapered surfaces equally spaced about the longitudinal axis of the housing. Each outer tapered surface on the wedge member is operably associated with an inner surface on each friction member so as to define a second angled friction sliding surface therebetween. The wedge member produces a radially directed force against the friction members upon movement of method for coupling two railcars to each other the wedge member inwardly of the housing. A spring seat is arranged within the housing. One surface of the spring seat is arranged in operable engagement with the second end of each friction member.

A spring assembly is disposed between the closed end of the housing and a second surface of the spring seat for storing, dissipating and returning energy imparted to the assembly by the coupler. The spring assembly includes an axial stack of individual elastomeric springs and is configured to function in operable combination with the disposition of the first and second angled sliding surfaces of the draft gear assembly relative to the longitudinal axis of the draft gear assembly such that the draft gear assembly consistently and repeatedly withstands about 110,000 ft-lbs. of energy imparted to the draft gear assembly at a force level not to exceed 900,000 lbs. over a range of travel of the wedge member in an inward axial direction relative to the housing of about 4.5 inches. As such, and with the present invention disclosure, the high level impact forces between railcars can be remarkably absorbed and dissipated without having to change or otherwise modify the overall length of the railcar.

Preferably, the method for releasably coupling to railcars to each other includes the further step of: configuring the spring assembly for the draft gear assembly to further include a rigid separator plate disposed between two axially adjacent individual springs in the axial stack of elastomeric springs so as to create different dynamic elastic absorption characteristics on opposite sides of the separator plate whereby optimizing dynamic lost work opportunities during an impact event of the draft gear assembly. The methodology according to this aspect of the present invention disclosure preferably furthermore includes the step of: designing the elastomeric pad of each individual elastomeric spring with a Shore D hardness ranging between about 40 and 60.

The methodology further involves the step of: configuring the head portion of the coupler such that a longitudinal distance of about 10.75 inches separates the back surface of the head portion from the end portion. Preferably, the coupler head portion is configured with a locklifter shelf disposed about 2 inches above a bottom edge of the coupler. The preferred methodology further involves the step of: configuring the shank portion of the coupler with a closed ended slot having a longitudinal length of about 8 inches.

DETAILED DESCRIPTION

Figure 1:
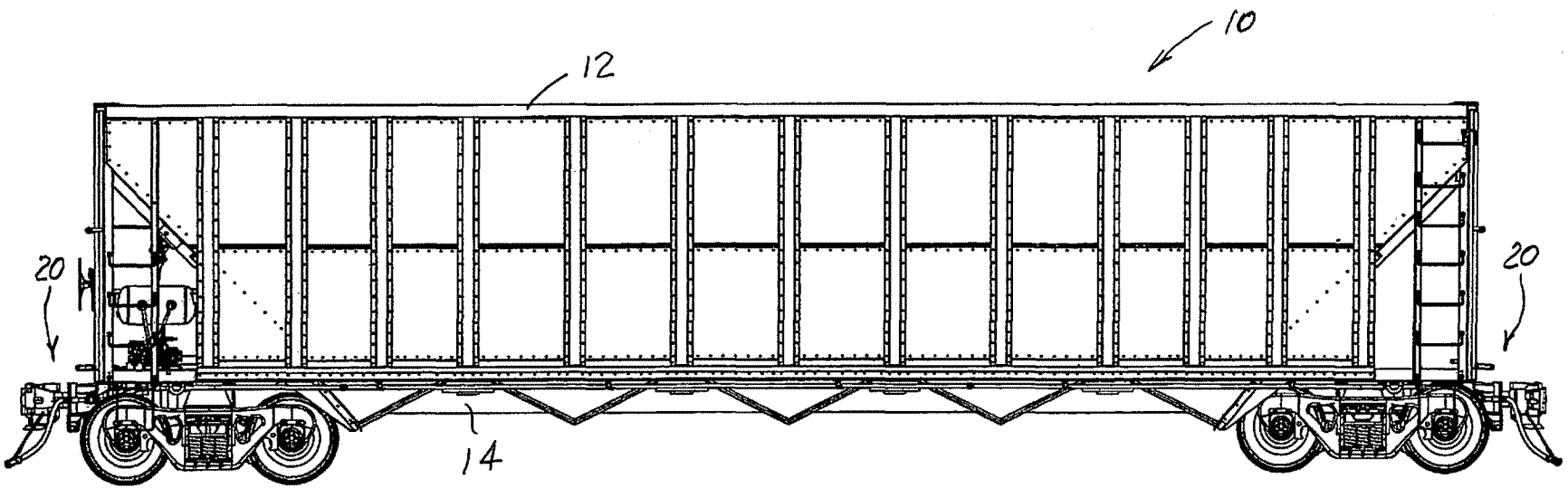
FIG. 1 is a side view of a railcar embodying principals and teachings of this invention disclosure.

While this invention disclosure is susceptible of embodiment in multiple forms, there is shown in the drawings and will hereinafter be described preferred embodiments, with the understanding the present disclosure is to be considered as setting forth exemplifications of the disclosure which are not intended to limit the disclosure to the specific embodiments illustrated and described.

Referring now to the drawings, wherein like reference numerals indicate like parts throughout the several views, there is shown in FIG. 1 a railroad car, generally indicated by reference numeral 10. Although a railroad freight car is illustrated in the drawings for exemplary purposes, it will be appreciated the teachings and principals of this invention disclosure relate to a wide range of railcars including but not limited to railroad freight cars, tank cars, railroad hopper cars, and etc. Suffice it to say, railcar 10 has a railcar body 12, in whatever form, supported on a centersill 14 (FIG. 2) defining a longitudinal axis 16 (FIG. 2) for and extending substantially the length of railcar 10.

As shown in FIG. 1, an energy absorbing/coupling system, generally identified by reference numeral 20, and embodying teachings and principals of this invention disclosure is provided toward opposed ends of the railcar 10. In a preferred embodiment, and to reduce costs, the energy absorbing/coupling system provided toward opposed ends of the railcar 10 are substantially identical and, thus, are both identified by reference numeral 20.

Figure 2:
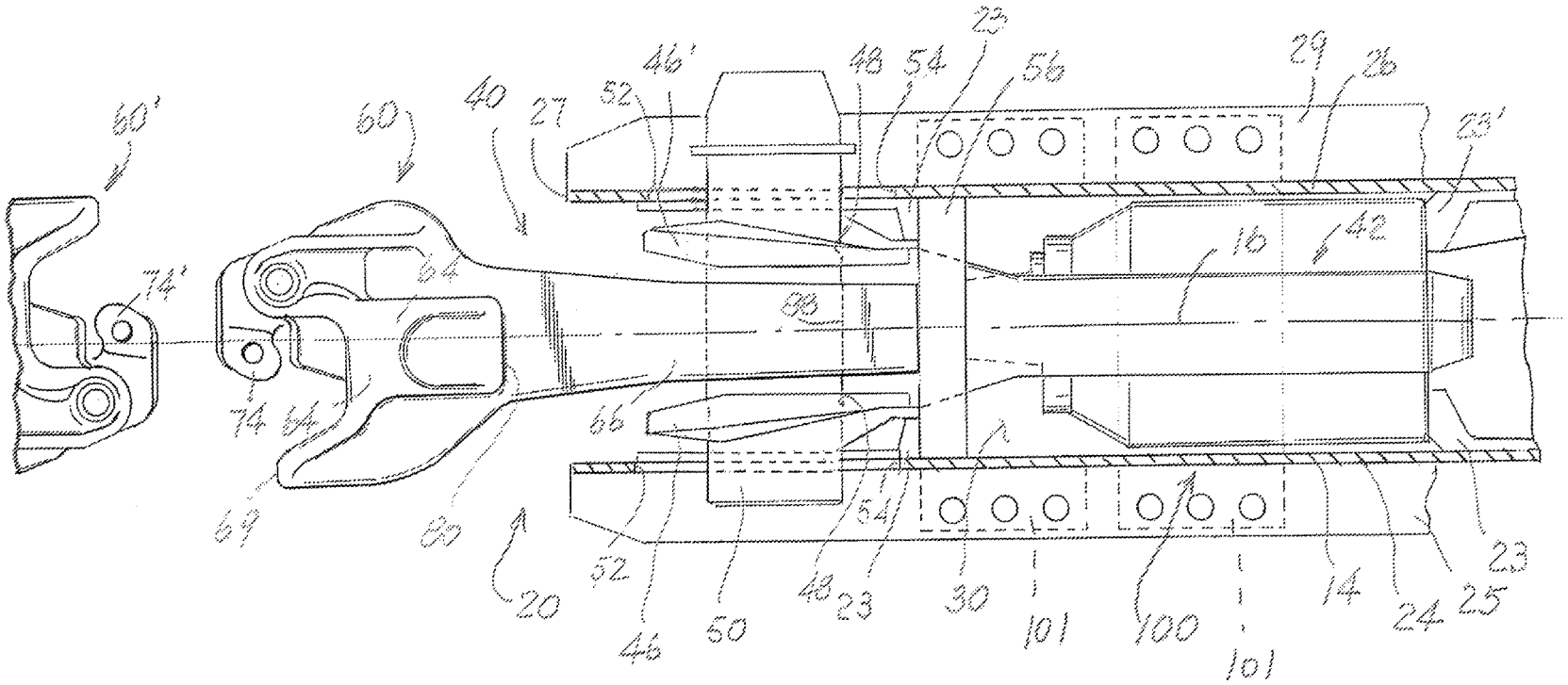
FIG. 2 is a fragmentary sectional view of an energy absorption/coupling system embodying principals and teachings of this invention disclosure.

The centersill 14 shown by way of example in FIG. 2 can be cast or fabricated and has standard features. Advantageously, no modifications or changes are required to the centersill 14 when the energy absorbing/coupling system 20 of this invention disclosure is arranged in operable combination therewith. In the embodiment shown in FIG. 2, and toward each end thereof, the centersill 14 has stops including front stops 23 and rear stops 23' connected to spaced walls 24 and 26 of the centersill 14. The front and rear stops 23 and 23', respectively, are longitudinally spaced apart from each other. Toward each end, and in the preferred embodiment, the centersill 14 is provided with a striker 27 (with only one being shown in FIGS. 2, 3 and 8).

Figure 4:
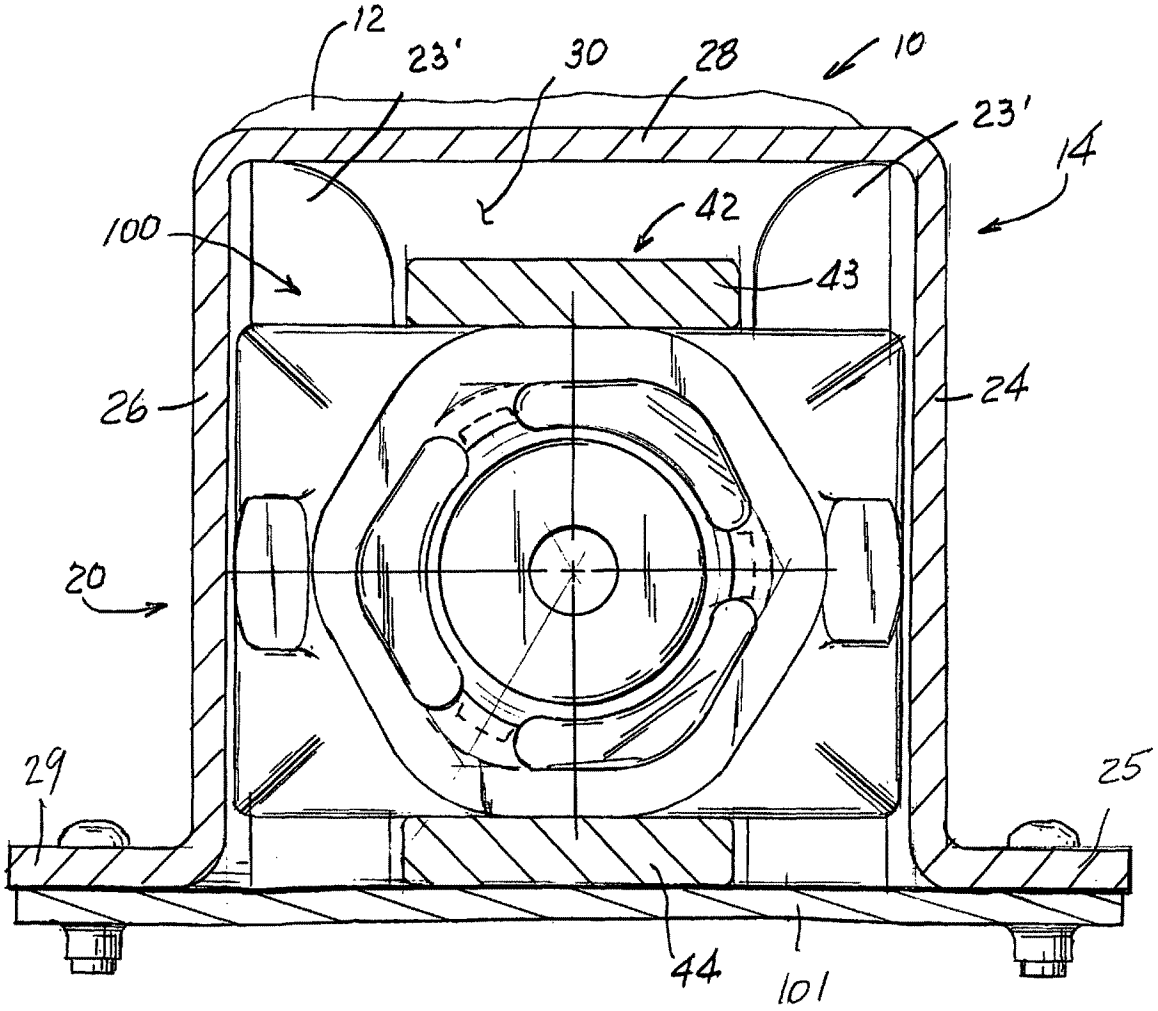
FIG. 4 is an enlarged sectional view taken along line 4-4 of FIG. 3.
Figure 5:
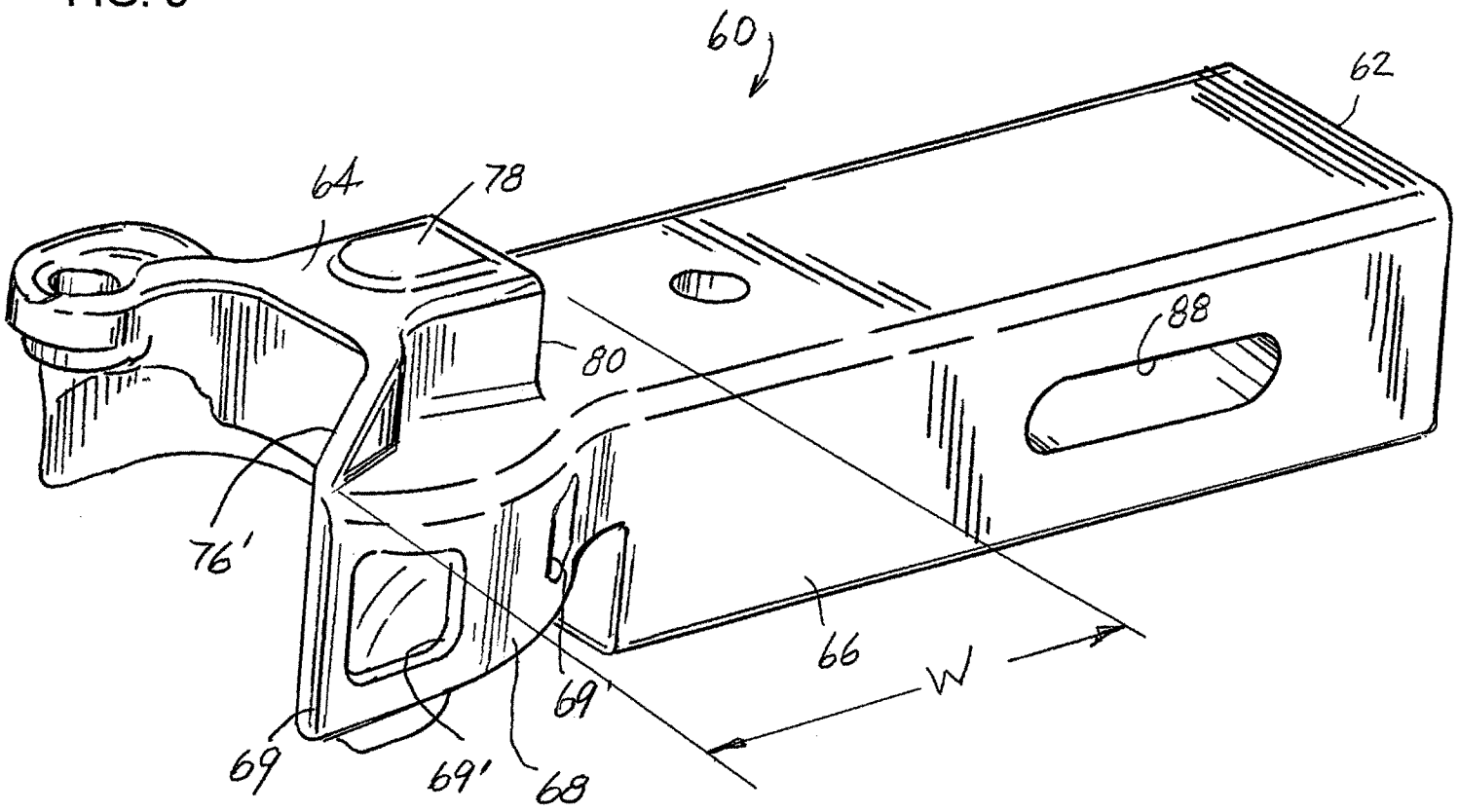
FIG. 5 is a perspective view of a coupler forming part of the energy absorption/coupling system of this invention disclosure.

In the embodiment shown in FIG. 4, the centersill 14 also has a top wall 28, although it will be appreciated the present invention disclosure is equally applicable to and can be used with a centersill lacking such a top wall. Suffice it to say, the stops 23, 23' (FIG. 2) on the centersill 14 combine to define a draft gear pocket 30 therebetween. The centersill 14 can have other standard features and is preferably made of standard materials in standard ways. The energy absorbing/coupling system 20 of this invention disclosure may advantageously be used with either cast or fabricated draft sills.

Each pocket 30 is a standard AAR size. That is, the longitudinal distance between the inboard faces of the front stops 23 to the inboard faces of the rear stops 23' is 24.625 inches. Advantageously, the draft gear assembly 100 forming part of the energy absorbing/coupling system 20 of this invention disclosure is designed to be accommodated and fits within existing standard centersills with standard-sized draft gear pockets.

Each energy absorbing/coupling system 20 includes a draft assembly 40 primarily including a coupler 60 and a draft gear assembly 100 disposed in longitudinally disposed and operable combination relative to each other. As discussed in further detail below, a portion of each coupler 60 extends longitudinally outward beyond the respective striker 27 toward the end of the centersill 14 so as to operably interconnect with a coupler 60' of an adjacent railcar to be operably connected thereto.

Figure 3:
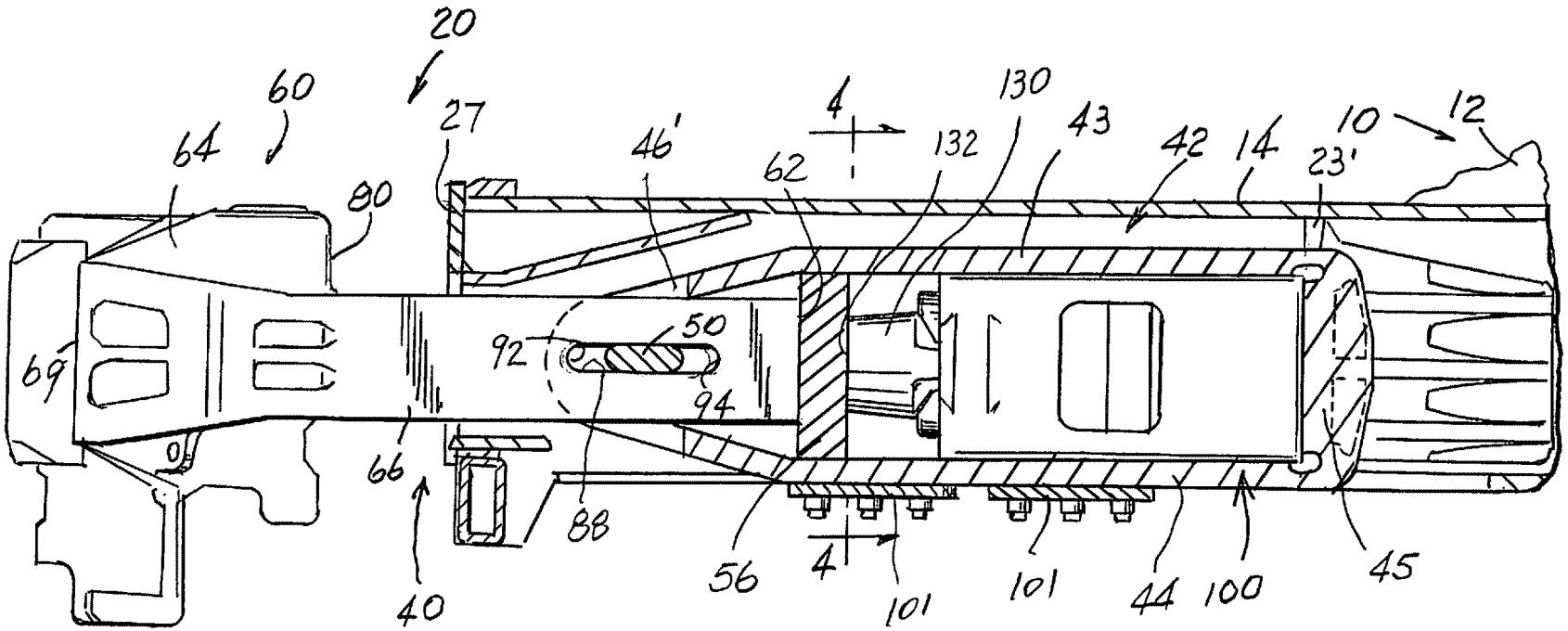
FIG. 3 is a fragmentary longitudinal sectional side view of an energy absorption/coupling system embodying principals and teachings of this invention disclosure.

Preferably, each draft assembly 40 furthermore includes a yoke 42 which, in one form, comprises a steel casting or it can be fabricated from separate steel components. As is typical, and as shown in FIG. 3, yoke 42 has a top wall 43, a bottom wall 44 and a back wall 45 preferably formed integral relative to each other. The top wall 43 and bottom wall 44, are connected toward their rear ends by the back wall 45. As known, the top wall 43 and bottom wall 44 extend generally parallel relative to each other and extend away from the back wall 45 toward the end of the centersill 14 so as to embrace the draft gear assembly 100 therebetween (FIG. 4).

Opposite the back wall 45, yoke 42 also preferably includes a pair of transversely spaced forward extending side walls 46 and 46' connected to the top and bottom walls 43 and 44, respectively, (FIG. 2). The side walls 46, 46' define substantially identical horizontally aligned key slots 48 for receiving a coupler key 50. As shown in FIG. 2, and toward opposite ends, each slot 48 defines a stop 52, 54 for limiting the extent the coupler key 50 can travel therewithin during operation of the draft assembly 40. In the illustrated embodiment, the longitudinal distance between the stops 52, 54 has been lengthened from that conventionally associated with yoke 72 so as to accommodate the lengthened travel of the coupler key 50 resulting from the advantageous change in the length of the travel of the coupler 60 discussed in detail below.

In the embodiment shown by way of example in FIGS. 2 and 3, each draft assembly 40 furthermore includes a follower 56 disposed between an inner end 62 of the coupler 60 and the draft gear assembly 100. In one embodiment, the follower 56 is movable between the top wall 43 and bottom wall 44 of the associated yoke 42 in a forward and rearward longitudinal direction.

The coupler 60 of each draft assembly 40 has a longitudinal axis 61 (FIG. 6) and includes a head portion 64 and shank portion 66, preferably formed as a one-piece casting. In operation, the shank portion 66 is guided for generally longitudinal movements by the centersill 12 of the railcar (FIGS. 2 and 3). As is typical, the coupler head portion 64 of coupler 60 extends longitudinally outward from the centersill 14 (FIGS. 2 and 3) to engage a similar coupler 60' (FIG. 2) extending from an end of a second and adjacent railcar to be releasably coupled or otherwise connected to car 10.

Figure 6:
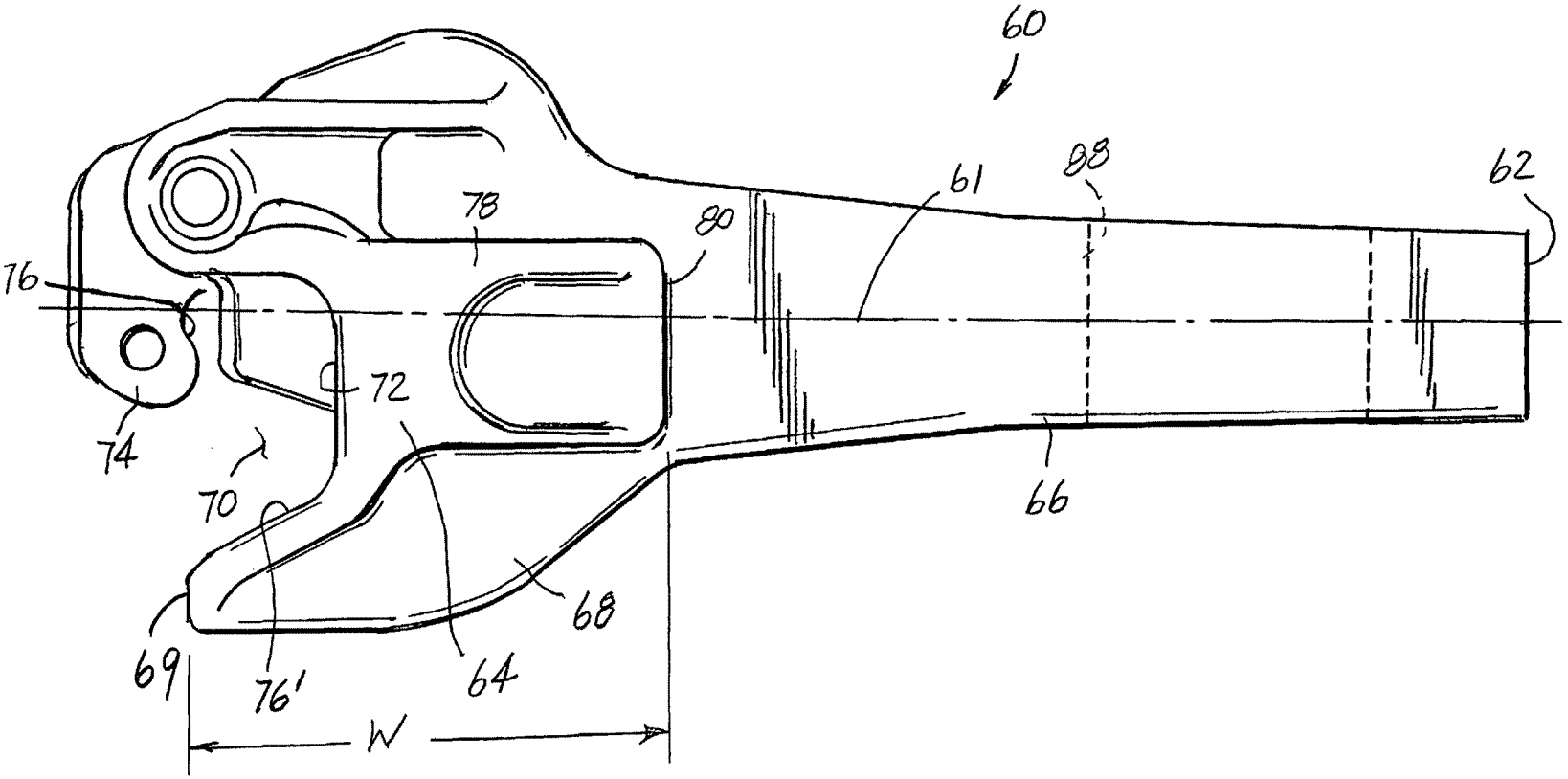
FIG. 6 is a top plan view of the coupler illustrated in FIG. 5.
Figure 7:
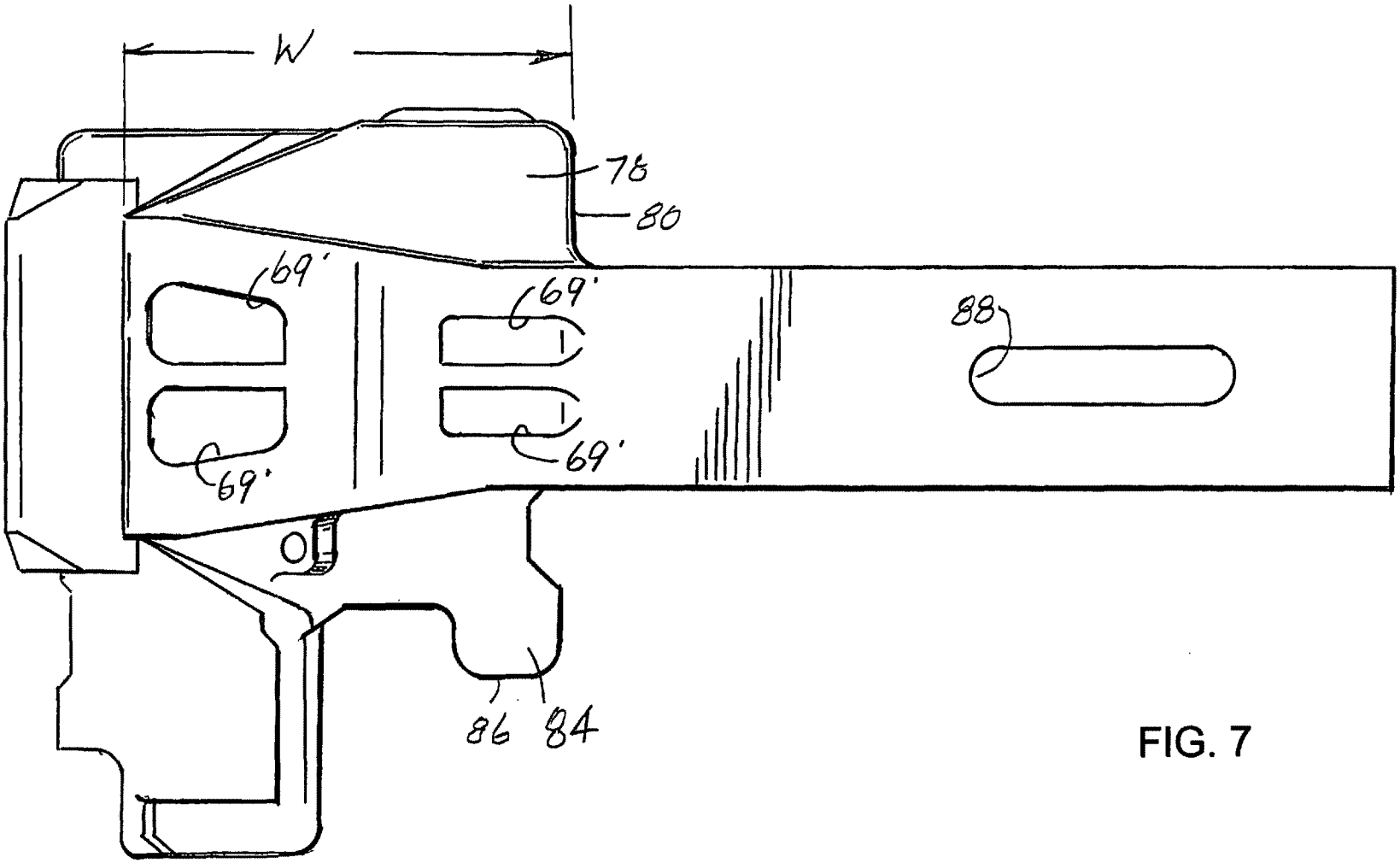
FIG. 7 is a side elevational view of the coupler illustrated in FIG. 5.

In the embodiment illustrated in FIG. 6, the coupler head portion 64 has an enlarged and generally V-shape, in plan, and defines a recess 70 which opens to that end of the head portion 64 opposite from the shank portion 66 and is at least partially defined by a forward wall 72. The head portion 64 of coupler 60 also includes a vertical knuckle 74 rotatably pinned toward an outer end of and substantially disposed to one lateral side of the longitudinal axis 61 of the coupler 60. The vertical knuckle 74 defines a pulling face 76 for and forms a first leg for the coupler 60. A fixed and rigid guard arm portion 68 is disposed to an opposite lateral side of the axis 61 of the coupler 60 and longitudinally extends from a free nose end 69 toward the shank portion 66 to form a second leg of the coupler 60. In a preferred form, the guard arm portion 69 defines a series of openings or cavities 69'.

In the illustrated embodiment, the recess 70 in the coupler head portion 64 is also partially defined by a first angled gathering surface 76' extending from the nose end 69 toward the shank portion 66 and against which the vertical knuckle 74' on the mating coupler 60' (FIG. 2) is intended to impact when two adjacent railroad freight cars are brought together. When the vertical knuckle 74 of the respective coupler impacts with and against the angled gathering surface of the adjacent coupler to be joined thereto, the knuckles pivot inward to a degree sufficient to lock them in place behind each other such that the couplers 60 and 60' are properly and releasably connected to each other.

Figure 8:
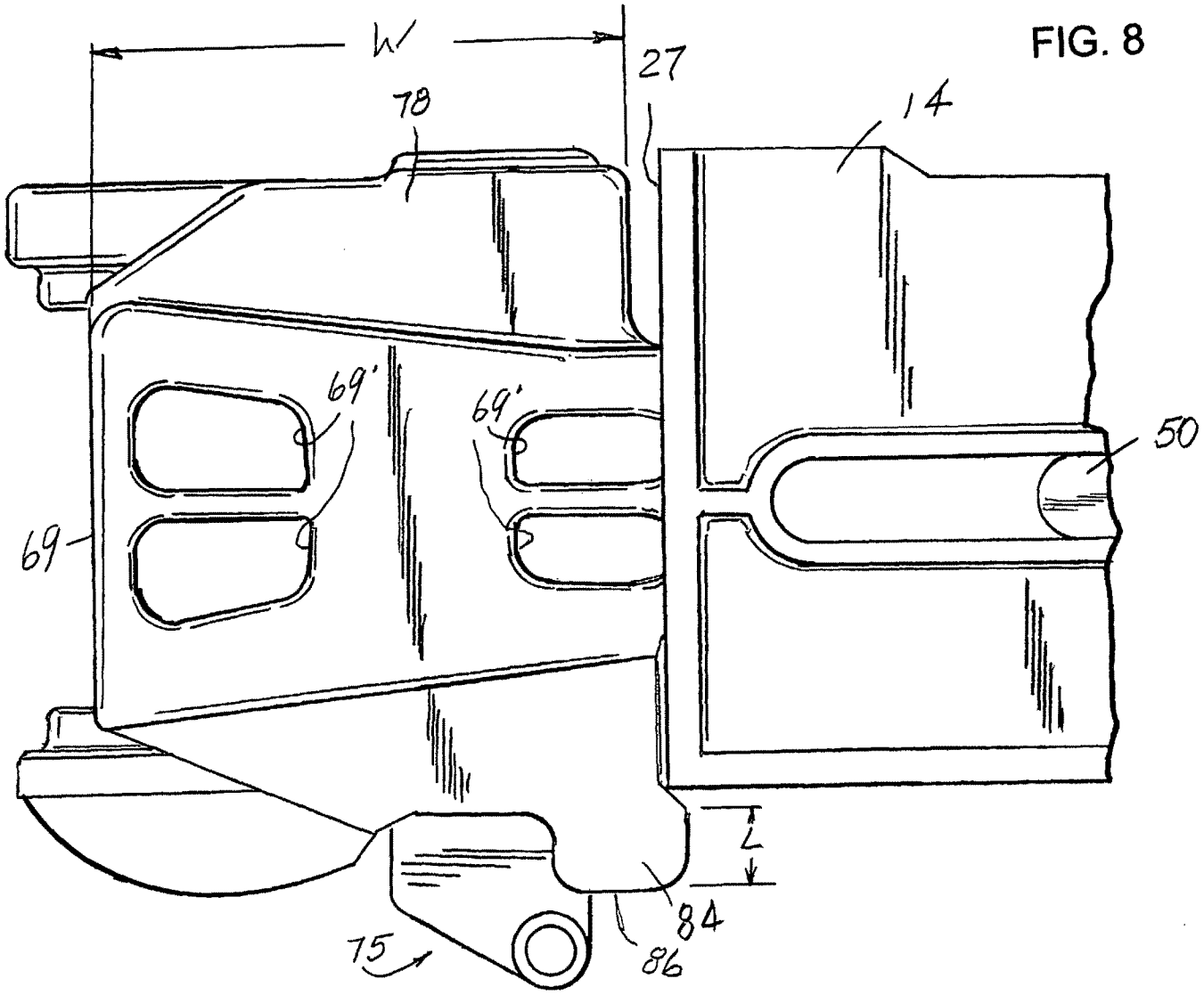
FIG. 8 is a fragmentary elevational view of the coupler arranged in operable combination with a centersill of a railcar.

A conventional locking mechanism, generally identified by reference numeral 75 in FIG. 8, is arranged in operable combination with each coupler head portion 64. As known, the locking mechanism 75 is activated by the engaging impact of the couplers 60, 60' relative to each other. In one embodiment, the locking mechanism 75 includes a pin (not shown) which slides downward within the coupler head portion 64 and releasably locks the respective vertical knuckle 74 in place whereby releasably joining the two railcars to each other. To assure a successful coupling operation, the two railcars to be coupled to each other are preferably located on a generally straight length of track, with the two couplers facing in confronting relation relative to each other. The couplers are disposed generally parallel to the track and are preferably arranged in generally perpendicular relation relative to an end of the railcar.

As shown by way of example in FIGS. 5 through 9, the coupler head portion 64 furthermore includes a horn portion 78 projecting vertically upward from the head portion 64. In the illustrated embodiment, the horn portion 78 longitudinally extends a referenced distance W between the nose end 69 on the head portion 64 and a back or rear wall or surface 80. As shown in FIG. 6, the back surface or wall 80 of the head portion 64 extends generally transverse or generally perpendicular to the longitudinal axis 61 of the coupler 60.

Because of the relatively high impact forces incurred during coupling of two railcars to each other, whether resulting from the railcars traveling faster than five miles per hour during the coupling process or otherwise, cracks can and have been known to form around the back surface 80 (e.g. typically as a result of the back surface 80 impacting and abutting with and against the striker 27 (FIG. 8) on the centersill 14). With this invention disclosure, and to minimize such cracking and related wear on the coupler 60, the width W between the nose end 69 on the head portion 64 and a back or rear wall or surface 80 on the horn portion 78 has been reduced to allow for a longer travel of each energy absorption/coupling system 20 (FIGS. 2 and 3) during coupling of two adjacent cars to each other and otherwise during normal operation of the railcar.

Figure 9:
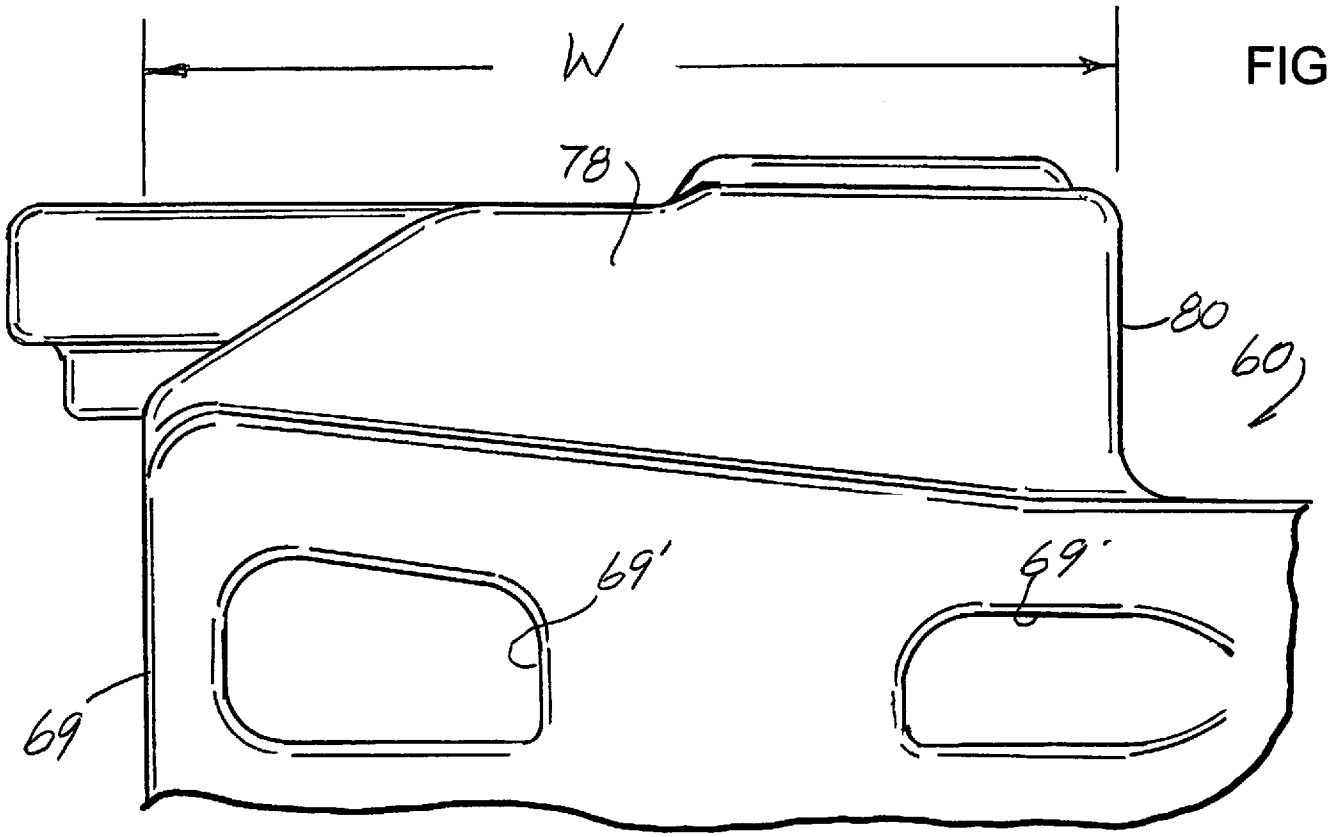
FIG. 9 is a fragmentary side elevational view of an upper front end of the coupler.

With this invention disclosure, the coupler 60 is preferably designed and configured to yield at least 4.5 inches of travel in a single longitudinal direction relative to the centersill 14 of the car 10 (FIG. 9). More specifically, the back surface 80 on the horn portion 78 of the coupler 60 is configured relative to the nose end 69 such that the coupler 60 is permitted to travel up to at least 4.5 inches in a single longitudinal direction relative to the centersill 14 of the railcar 10 (FIG. 1).

To effect such advantageous ends, the distance W between the nose end 69 and the back surface 80 on the horn portion 78 has been reduced from that associated with a conventional coupler. That is, in the illustrated embodiment, the distance W between the nose end 69 and the back surface 80 on the horn portion 78 has been beneficially reduced by approximately 1.25 inches in a single longitudinal direction as compared to a conventional coupler. As such, the coupler 60 of this invention disclosure allows for approximately at least a 1.25 inch increase in travel in a single longitudinal direction for the components comprising each energy absorbing/coupling system 20 of this invention disclosure. That is, and as compared to a conventional coupler, the coupler 30 of this invention disclosure beneficially allows for approximately a 1.25 inch increase in travel of the coupler 30 between the time the adjacent couplers operable engage with each other and the components draft gear assembly fully compress and go solid. This additional travel length also beneficially reduces the possibility the back surface 80 on the horn portion 78 will strike or otherwise impact with the striker 27 (FIG. 3), thus, significantly reducing the likelihood of damages to the coupler 60 due to cracking and related consequential damages to the railcar 10 (FIG. 1) due to impacts.

In a preferred embodiment, the distance W between the nose end 69 and the back surface 80 on the horn portion 78 is approximately 10.75 inches. Of course, and without detracting or departing from the true spirit and scope of this invention disclosure, other embodiments of this invention disclosure can include a distance W having another dimension (such as less than 11 inches) but still reduced from the conventional 12 inches to allow for increased travel of the coupler 60 during railroad couplings. In some embodiments, the travel distance of the coupler 60 in a single longitudinal direction relative to the centersill 12 during a coupling procedure may increase from approximately 3.75 inches to greater than 4.5 inches. In the embodiment where the distance W measures approximately 10.75 inches, the travel of the coupler 60 in a single longitudinal direction relative to the centersill 14 during a coupling procedure may be approximately 5 inches. The above-mentioned changes to the coupler 60 notwithstanding, the conventional components forming the locking mechanism 75 are unchanged.

As will be readily appreciated by those skilled in the art, such an enhanced design, translates into a cumulative increase in travel of both couplers 60 on the railcar 10 to approximately 10 inches without any resultant changes to the overall length of the railcar 10. As will be further appreciated by those skilled in the art, the ability to increase the length of longitudinal travel of the coupler 60 readily translates into an increase in the distance over which each draft assembly 20 can effectively operate to cushion and absorb the impact loads imparted to the railcar 10 during coupling and related operations.

As is conventional, coupler 60 preferably includes a locklifter shelf 84. Research has revealed, however, when the longitudinal travel of the coupler 60 relative to the centersill 12 increases, especially to the extent possible with this invention disclosure, a conventionally designed and configured locklifter shelf can and often does interfere with and/or impact with the centersill 12 during a coupling operation.

To advantageously allow for longer longitudinal travel of the coupler 60 in a single direction relative to the centersill 12 during a coupling operation, the locklifter shelf 84 of the present invention disclosure has preferably been lowered compared to conventional designs. In the form illustrated in FIG. 10, the length L of the locklifter shelf 84 has been lowered approximately 0.5 inches from a conventionally designed shelf to allow for longer longitudinal travel of the coupler 60 in a single direction relative to the centersill 12 during a coupling operation.

Figure 10:
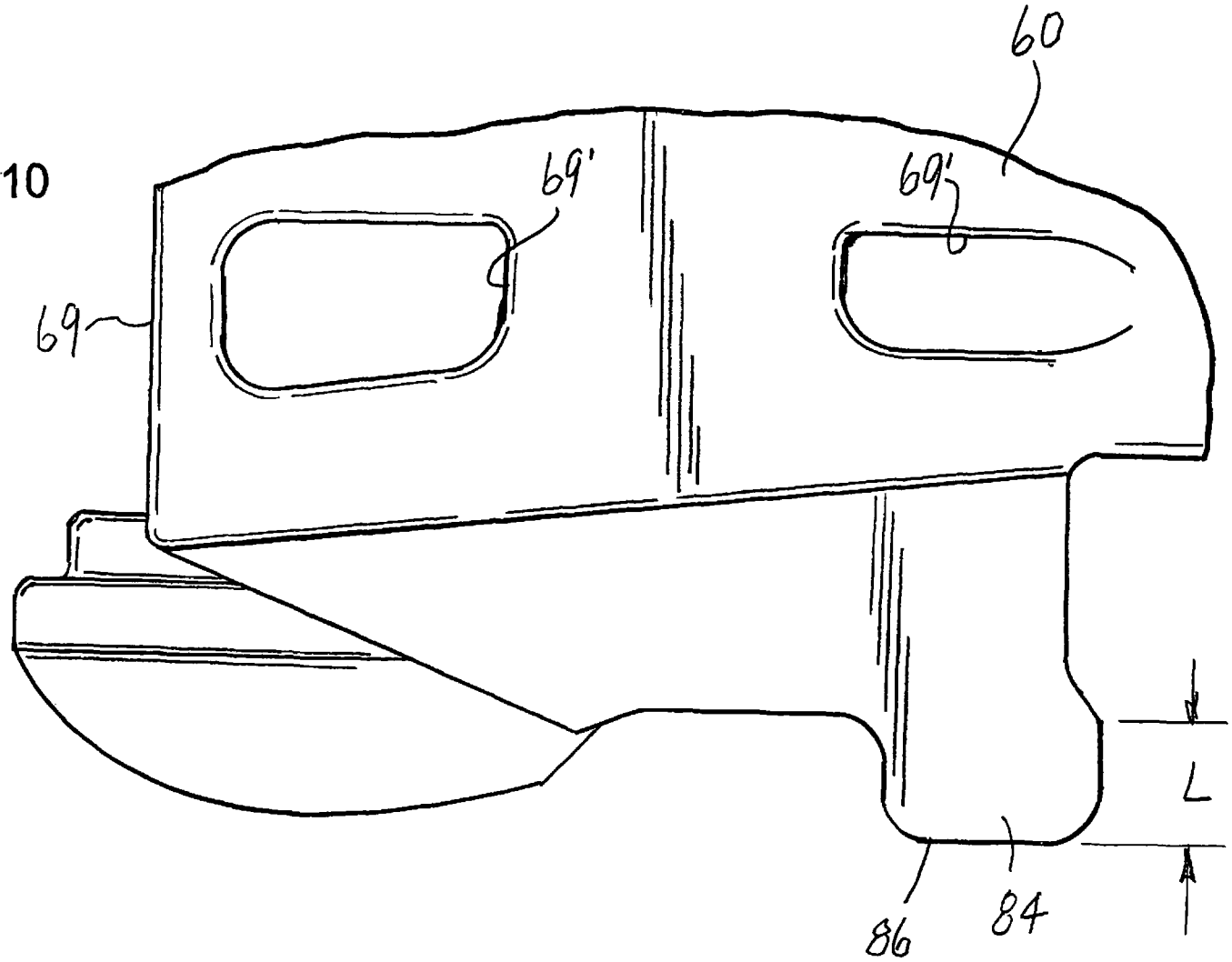
FIG. 10 is a fragmentary side elevational view of one form of a lower front end of the coupler.

In the preferred embodiment shown in FIG. 10, the length L of the locklifter shelf 84 extends between approximately 1.875 inches and approximately 2.0 inches above a bottom edge 86 of the coupler 60. Of course, and without detracting or seriously departing from this novel aspect and the overall scope of this invention disclosure, other embodiments can include a shelf having a length L having another dimension (such as less than 2 inches) but still reduced from the conventional 2.375 inches to minimize interference between the coupler 60 and the centersill 12 of the railcar 10 while allowing for increased travel of the coupler 30 during railroad couplings.

As shown in FIG. 6, the shank portion 66 of coupler 60 defines a longitudinally extending or horizontal key slot 88 which is sized to allow the coupler key 50 to extend endwise therethrough whereby operably connecting the coupler 60 to the yoke 42. The aligned key slots 48 of the yoke 42 and the corresponding key slot 88 in the coupler shank portion 66 have longitudinal dimensions greater than that of the coupler key 50.

Toward opposite ends, the key slot 88 defines a stop 92 and 94 for limiting the extent the coupler key 50 can travel therewithin during operation of the draft assembly 40. Notably, the longitudinal length of the key slot 88, i.e., the horizontal distance between the stops 92, 94 is increased over the length of a key slot in a conventional coupler to allow for longer travel of the coupler 60 during a coupling operation. When the draft assembly 40 is in a draft position, the coupler key 50 contacts the forward stops 52 defined by the key slot 48 in the walls 46, 46' of the yoke 42 whereby pulling the yoke 42 along with the draft gear assembly 100 toward the open end of the centersill. When the draft assembly 40 is in a buff position there is substantially no contact between the coupler key 50 and the stops 52, 54 of the yoke 42 or the stops 92, 94 of the key slot 88 in the shank portion 66 of coupler 60 such that the coupler key 50 is not under stress. Similarly, when the draft assembly 40 is in a neutral position there is substantially no stress on the coupler key 50.

In a conventional coupler, the horizontal length of the key slot in the coupler measures approximately 6.875 inches. As mentioned, the length of the key slot 88 defined by the coupler shank portion 66 of this invention disclosure, i.e., the horizontal distance between stops 92, 94, is increased over the length of the key slot in a conventional coupler shank portion to allow for longer longitudinal travel of the coupler key 50. In a preferred embodiment, the horizontal length between the stops 92, 94 of the key slot 88 defined by the coupler shank portion 66 is approximately 9.000 inches. As such, and during a coupling operation, the shank portion 66 of the coupler 60 of this invention disclosure can travel inwardly toward the draft gear assembly 100 for a further distance than in a conventional coupler arrangement. In this embodiment, the length of the key slot 88 is increased by approximately 2.75 inches as compared to a key slot in a conventional coupler. In other embodiments of this invention disclosure, the coupler travel toward the draft gear assembly during a coupling operation can be increased in other ways to enable longer coupler travel without detracting or departing from the spirit and novel scope of this invention disclosure. In alternative embodiments, the length of the key slot 88 can be greater than 8.0 inches.

In a preferred embodiment of this invention disclosure, the increased travel or stroke of each coupler 60, resulting in large part from the changes and/or modifications to the horn portion 78 on the head portion 64 of the coupler together with the increase in the overall length of the key slot 88, has been advantageously accomplished while utilizing other conventional component parts in combination with the coupler. That is, known and tested operative qualities of the knuckle 74 and locking mechanism 75 have all beneficially been incorporated into the coupler 60 without having to incur design changes thereto.

With the present invention disclosure, the increased travel or stroke of the coupler of each energy absorption/coupling system 20 is advantageously used by the draft gear assembly 100 to beneficially smooth the significantly higher impact forces imparted to the railcar 10 (FIG. 1) over a longer than heretofore known range travel while maintaining the overall length of the railcar 10 generally constant. With the present invention disclosure, the draft gear assembly 100 of each system 20 can be relatively easily installed in operable combination with the coupler 60 without incurring design changes or modifications to the pocket 30 of the centersill 12 and thereby advantageously maintaining the overall length of the railcar 10 (FIG. 1) constant and unchanged. Once the draft gear assembly 100 is in place in the centersill 12, standard support members 101 (FIGS. 2 and 4) can be attached to flanges 25 and 29 on the walls 24 and 26, respectively to operably support the draft gear assembly 100 within pocket 30 and in operable association with the coupler 60.

Figure 11:
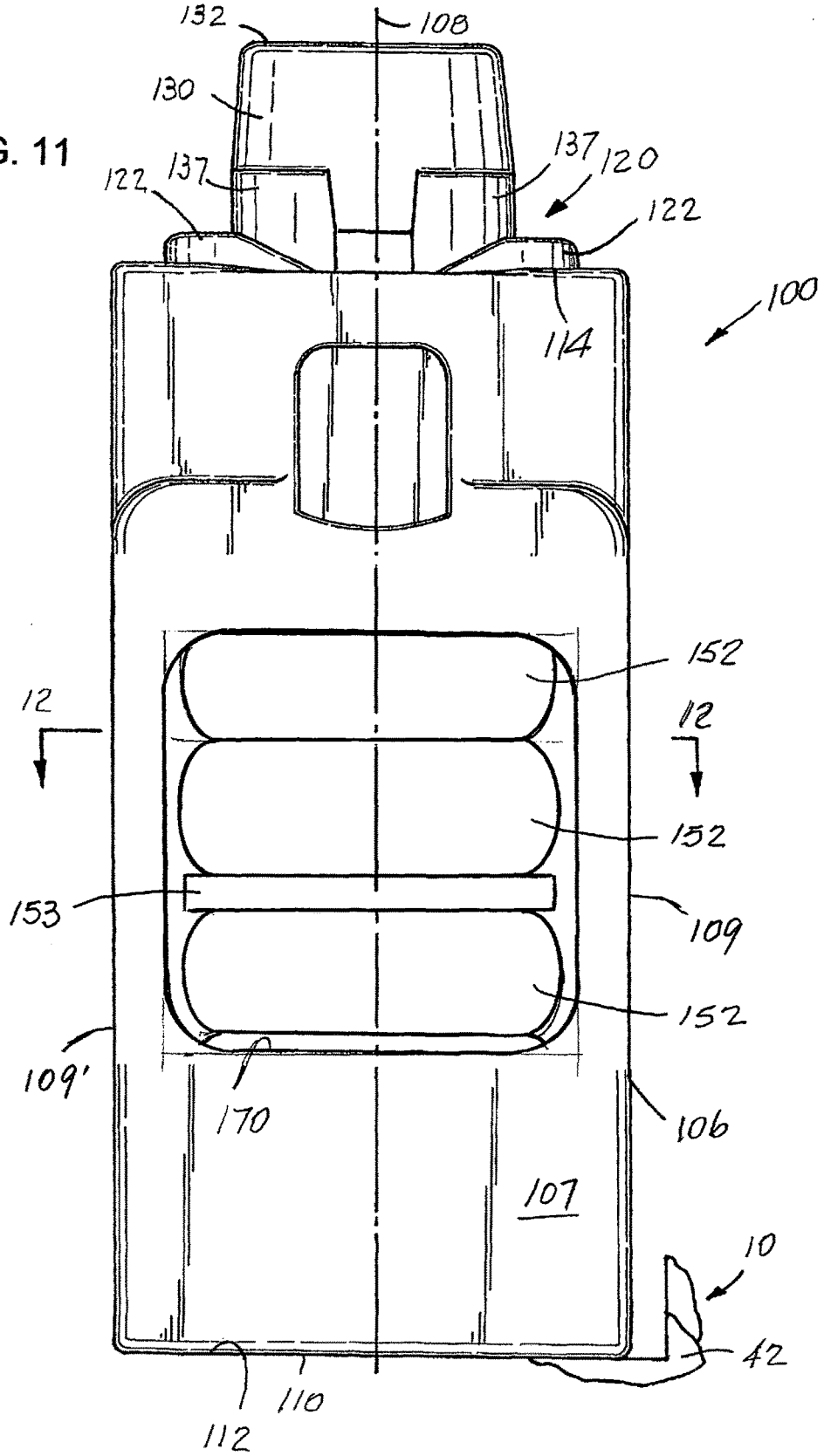
FIG. 11 is a side elevational view of a draft gear assembly forming part of the energy absorption/coupling system of this invention disclosure.
Figure 12:
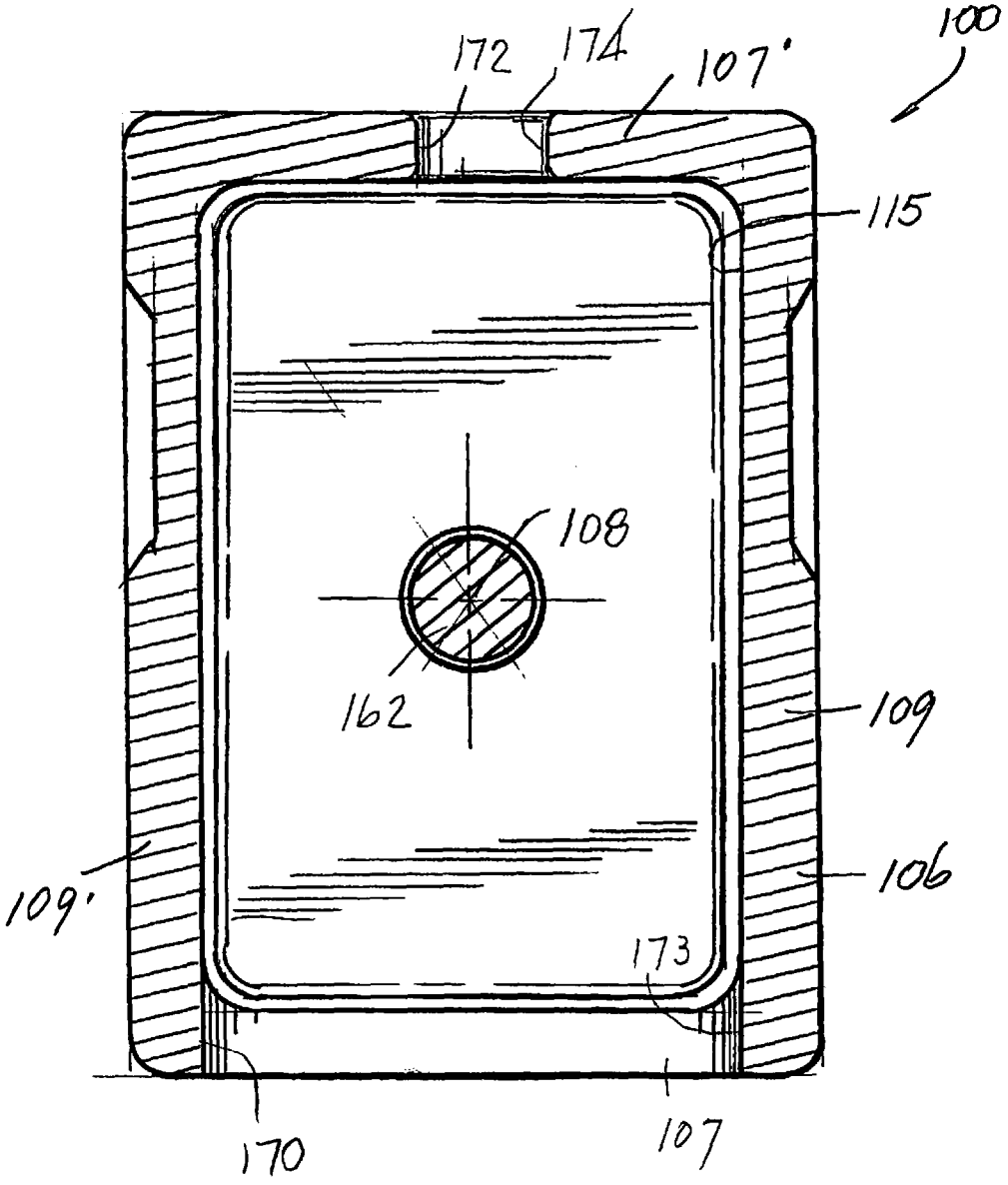
FIG. 12 is a sectional view taken along line 12-12 of FIG. 11.
Figure 13:
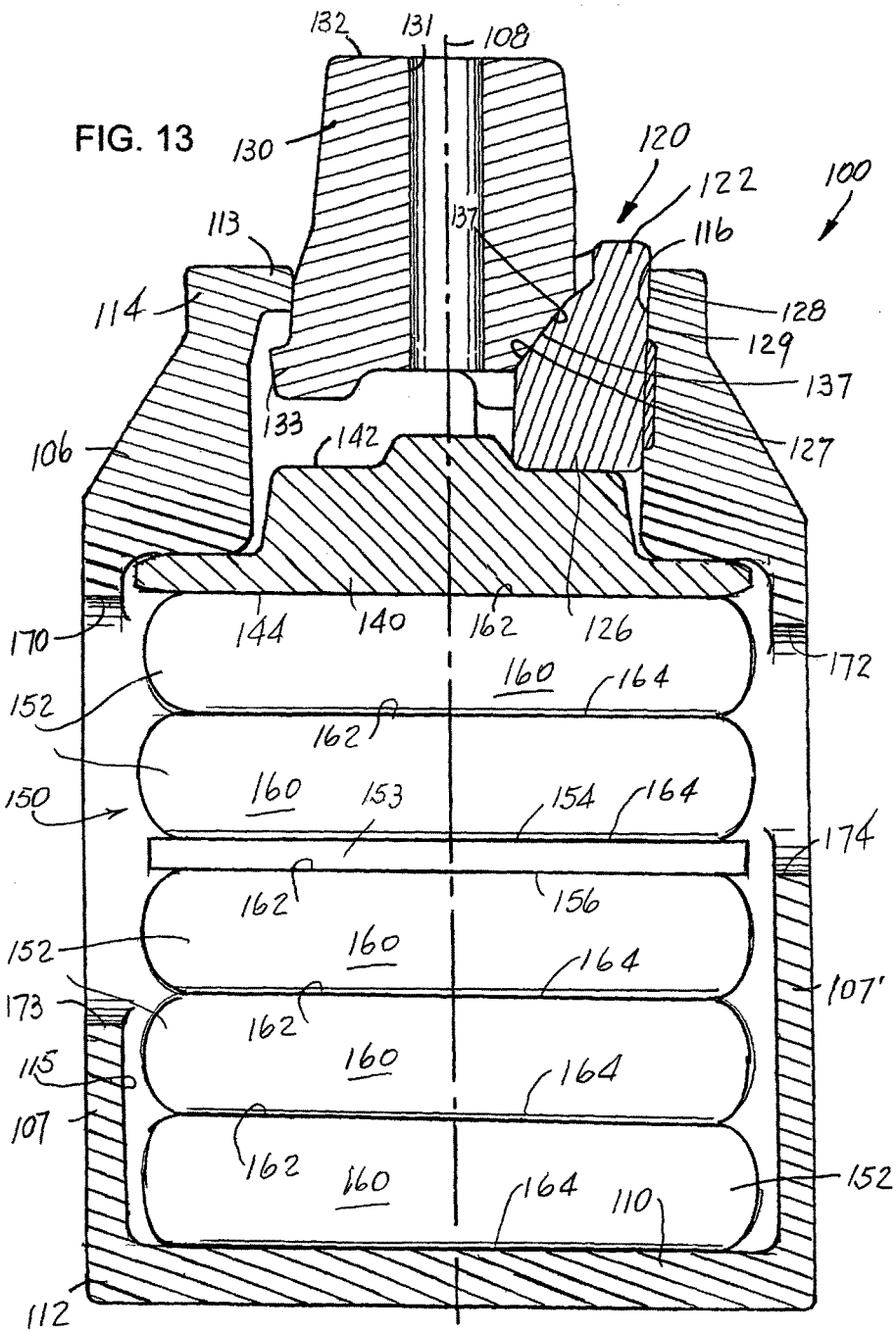
FIG. 13 is a longitudinal sectional view of the draft gear assembly illustrated in FIG. 11.

As shown in FIG. 11, draft gear assembly 100 includes an axially elongated hollow and metallic housing 106 defining a longitudinal axis 108 for draft gear assembly 100. Housing 106 is closed by an end wall 110 at a first or closed end 112 and is open toward an axially aligned second or open end 114. In the illustrated embodiment, housing 106 includes two pairs of joined and generally parallel walls 107, 107' and 109, 109' (FIG. 12), extending from the closed end 112 toward the open end 114 and defining a hollow chamber 115 within housing 106 (FIGS. 12 and 13). As shown in FIG. 12, the housing walls 107, 107' and 109, 109' provide the housing chamber 115 with a generally rectangular or boxlike cross-sectional configuration for a major lengthwise portion thereof.

Moreover, and as shown in FIG. 13, toward the open end 114, housing 106 is provided with a plurality (with only one being shown in FIG. 15) of equi-angularly spaced and longitudinally extended tapered inner angled friction surfaces 116. Each of the tapered inner angled friction surfaces 116 on housing 106 converge toward the longitudinal axis 108 and toward the closed end 112 of the draft gear housing 106. Preferably, housing 106 is provided with three equally spaced longitudinally extended and tapered inner angled friction surfaces 116 but more tapered surfaces could be provided without detracting or departing from the spirit and novel concept of this invention disclosure.

In the embodiment shown in FIG. 13, draft gear assembly 100 is also provided with a friction clutch assembly 120 for dissipating draft forces or impacts axially directed against the draft gear assembly 100 as a result of a coupling operation or normal operation of the railcar 10 (FIG. 1). In the embodiment shown in FIG. 13, the friction clutch assembly 120 includes a plurality of friction members or shoes 122 arranged about axis 108 and in operable combination with the open end 114 of the draft gear housing 106. As shown by way of example in FIG. 14, the friction clutch assembly 120 can be provided with three equi-angularly spaced friction members 122 but more friction members could be provided without detracting or departing from the spirit and novel concept of this invention disclosure. Suffice it to say, in the embodiment shown by way of example in FIGS. 13 and 14, the number of friction members 122 forming part of the friction clutch assembly 120 are equal in number to the number of tapered inner angled friction surfaces 116 on housing 106.

Figure 15:
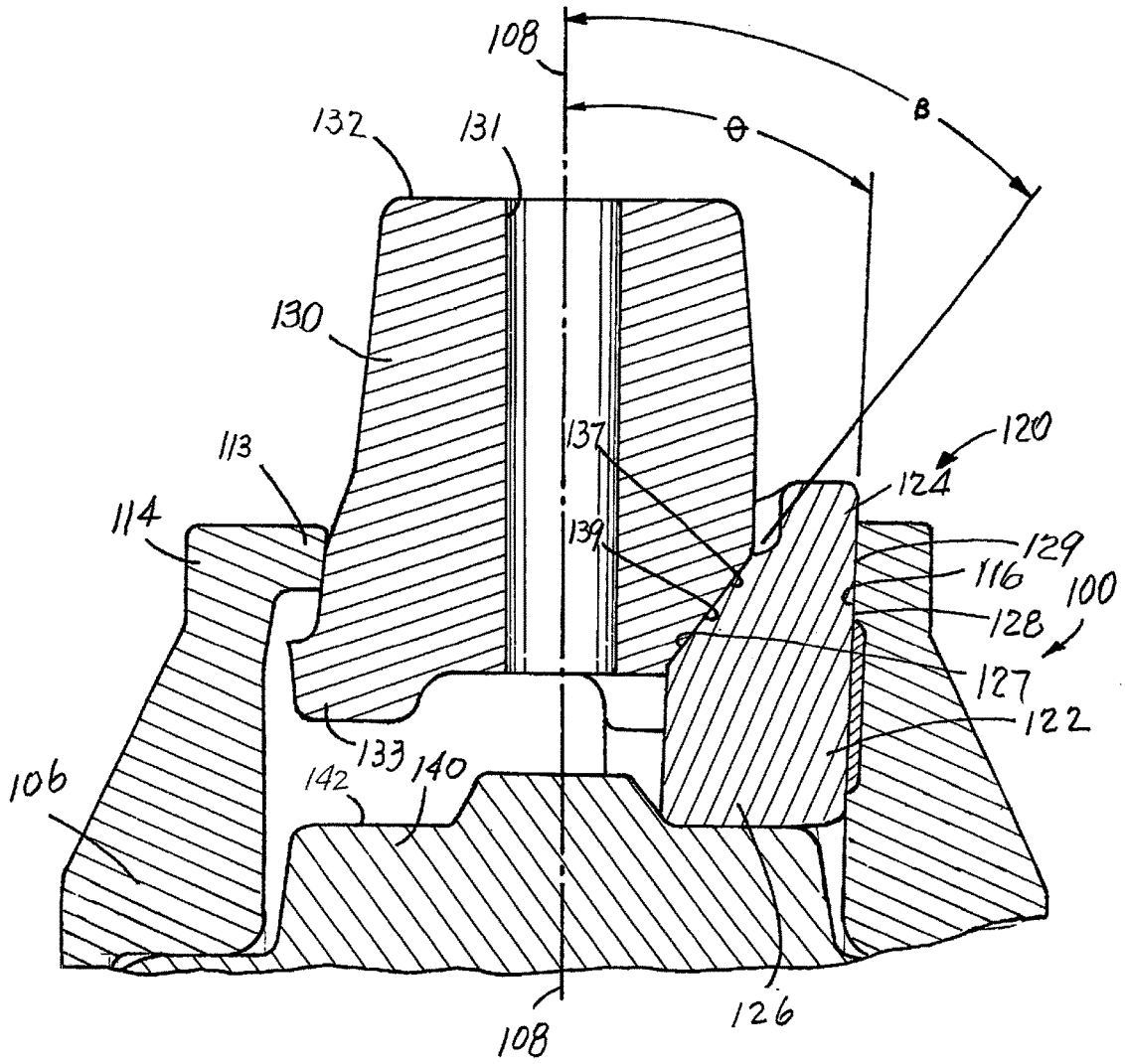
FIG. 15 is an enlarged sectional view of one end of the draft gear assembly illustrated in FIG. 11.

In the embodiment shown by way of example in FIG. 15, each friction member 122 has axially or longitudinally spaced first and second end 124 and 126. Moreover, each friction member 122 has an outer or external tapered sliding surface 128. As will be appreciated by those skilled in the art, each inner angled friction surface 116 on housing 106 combines with each outer tapered sliding surface 128 on each friction member 122 to define a first angled friction sliding surface 129 therebetween. The first friction sliding surface 129 is disposed at an angle θ relative to the longitudinal axis 108 of the draft gear assembly 100. The angle θ of the first friction sliding surface 129 ranges between about 1.5 degrees and about 5 degrees relative to the longitudinal axis 108 of the draft gear assembly 100. In a preferred embodiment, the angle θ of the first friction sliding surface 129 ranges between about 1.7 degrees and about 2 degrees relative to the longitudinal axis 108 of the draft gear assembly 100.

In the illustrated embodiment, the friction clutch assembly 120 further includes a wedge member or actuator 130 arranged for axial movement relative to the open end 114 of housing 106. As shown in FIGS. 11, 13 and 15, an outer end 132 of the wedge member 130 preferably has a generally flat face extending beyond the open end 114 of housing 106 for a distance measuring between about 4.5 inches and is adapted to press or bear against the follower 56 of the draft assembly 40 (FIG. 3) such that draft or impact forces applied to the coupler 60 are axially applied to the draft gear assembly 100 during operation of the railcar 10. As known, wedge member 130 is arranged in operable combination with the friction members 122.

Returning to FIG. 15, wedge member or actuator 130 defines a plurality of outer tapered or angled friction surfaces 137 arranged in operable combination with the friction members 122 of clutch assembly 120. Although only one friction surface 137 is shown in FIG. 15, the number of friction surfaces 137 on the wedge member 130 equals the number of fiction surfaces on members 122 forming part of the clutch assembly 120. As will be appreciated by those skilled in the art, each outer angled friction surface 137 on wedge member 130 combines with an inner angled sliding surface 127 on each friction member 122 to define a second angled friction sliding surface 139 therebetween. The second friction sliding surface 139 is disposed at an angle β relative to the longitudinal axis 108 of the draft gear assembly 100. Preferably, the angle β of the second friction sliding surface 139 of friction clutch assembly 130 ranges between about 32 degrees and about 45 degrees relative to the longitudinal axis 108 of the draft gear assembly 100.

Wedge member 130 is formed from any suitable metallic material. Moreover, and as shown in FIGS. 13, 14 and 15, the wedge member or actuator 130 defines a generally centralized longitudinally extending bore 131.

Figure 14:
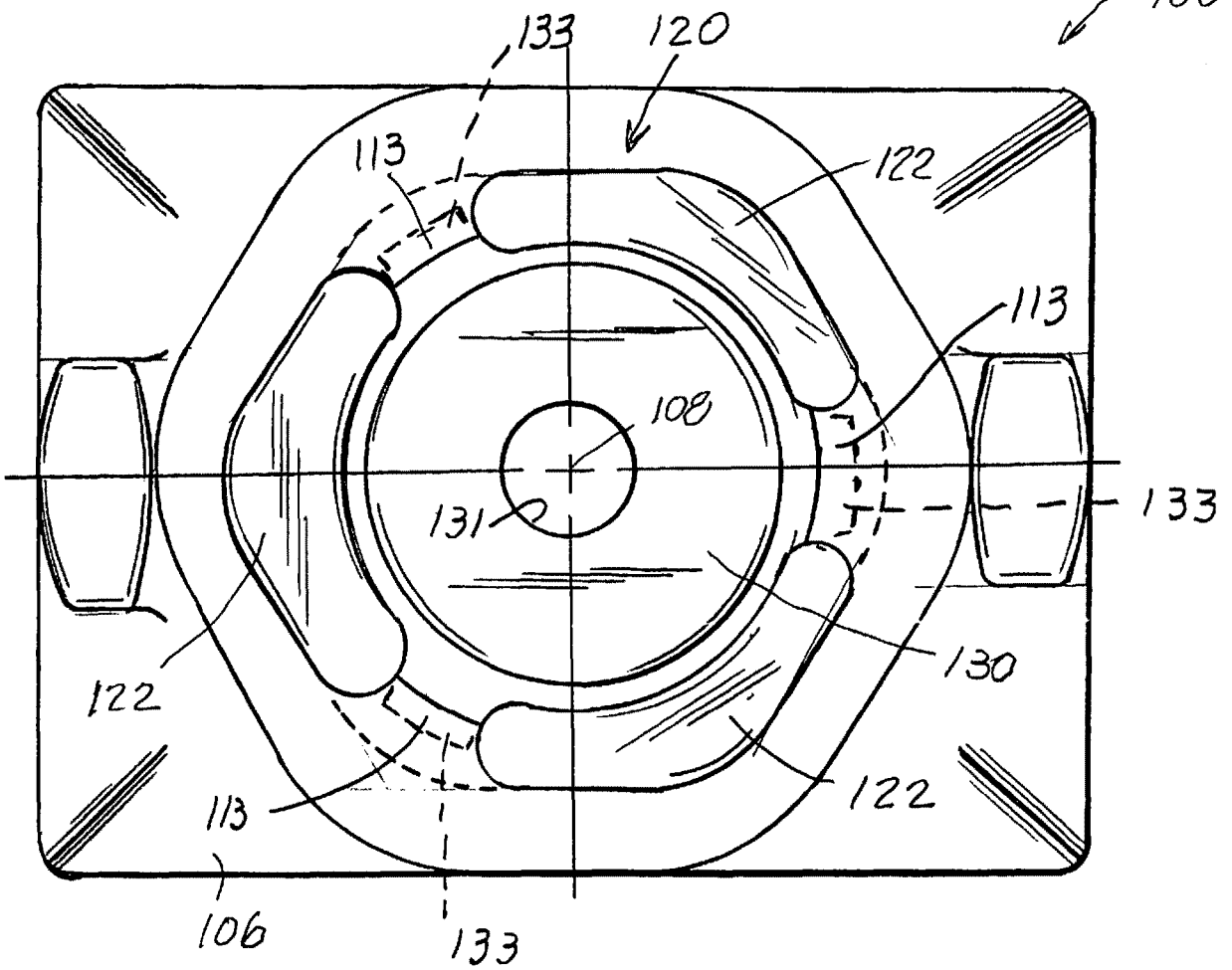
FIG. 14 is an axial plan view of the draft gear assembly illustrated in FIG. 11.

As shown in FIGS. 13, 14 and 15, toward the open end 114, housing 106 is provided with a series of radially inturned stop lugs 113 which are equi-angularly spaced circumferentially relative to each other. Toward a rear end thereof, wedge member 130 includes a series of radially outwardly projecting lugs 133 which are equi-angularly disposed relative to each other and extend between adjacent friction members 122 so as to operably engage in back of the lugs 113 on housing 106 and facilitate assembly of the draft gear assembly 100.

As shown in FIG. 15, draft gear assembly 100 furthermore includes a spring seat or follower 140 arranged within the hollow chamber 115 of housing 106 and disposed generally normal or generally perpendicular to the longitudinal axis 108 of the draft gear assembly 100. Spring seat 140 is adapted for reciprocatory longitudinal or axial movements within the chamber 115 of housing 106 and has a first surface 142 in operable association with the second or rear end 126 of each friction member 122. As shown in FIG. 13, spring seat 140 also has a second or spring contacting surface 144.

An axially elongated elastomeric spring assembly 150 is generally centered and slidable within chamber 115 of the draft gear housing 106 and forms a resilient column for storing, dissipating and returning energy imparted or applied to the free end 132 of wedge member 130 during axial compression of the draft gear assembly 100. One end of spring assembly 150 is arranged in contacting relation with the end wall 110 of housing 106. A second end of spring assembly 150 is pressed or urged against surface 144 of the spring seat 140 to oppose inward movements of the friction members 122 and wedge member 140 in response to the coupler 60 (FIG. 2) transferring impact forces to the draft gear assembly 100.

Spring assembly 150 is precompressed during assembly of the draft gear assembly 100 and serves to: 1) maintain the components of the friction clutch assembly 120, including friction members 122 and wedge member 130 in operable combination relative to each other and within the draft gear housing 106 both during operation of the draft gear assembly 100 as well as during periods of non-operation of the draft gear assembly 100; 2) maintain the free end 132 of the wedge member 130 pressed against the follower 56; and, 3) maintain the follower 56 pressed against the stops 23 on the centersill 12 (FIG. 2). In the illustrated embodiment, the spring assembly 150 in combination with the friction clutch assembly 120, is capable of absorbing and dissipating impacts or energy directed axially thereto up to about 900,000 lbs.

In the form shown in FIG. 13, spring assembly 150 is configured with a plurality of individual units or springs 152 arranged in axially stacked relationship relative to each other. In the form shown in FIG. 13, the spring assembly 150 is comprised of five springs 152 with a rigid separator plate 153 being disposed between two axially adjacent individual springs 152 in the stack of the springs. It will be appreciated that more than five springs 152 can be arranged in axially stacked relationship relative to each other without seriously detracting or departing from the novel nature and true scope of this invention disclosure.

As described in further detail below, the purpose of the separator plate 153 between the axially adjacent springs 152 is to provide the springs 152 with different dynamic elastic absorption characteristics on opposite sides of the plate 153 so as to optimize dynamic lost work opportunities during an impact event of the draft gear assembly 100. To effect such desirous ends, plate 153 is extremely rigid and is preferably formed from steel or the like. As shown in FIG. 13, the separator plate 153 has upper and lower generally planar and generally parallel spring engaging surfaces 154 and 156, respectively. In one form, a distance of about 0.375 inches and about 0.5 inches separates the spring engaging surfaces 154 and 156 on plate 153. In a preferred embodiment, the springs 152 disposed between the lower surface 156 of plate 153 and the lower wall 110 of housing 106 combine with each other to offer a greater resistance to compression than do the combination of springs 152 disposed between the upper spring engaging surface 154 of plate 153 and the spring engaging surface 144 of spring seat 140 during operation of the draft gear assembly 10.

Each cushioning unit or spring 152 includes an elastomeric pad 160. Preferably, each pad 160 has a configuration which complements the configuration, in plan, of the housing chamber 115. In a preferred form, each pad 160 has a generally rectangular shape, in plan, and is sized to optimize the rectangular area of the hollow chamber 115 wherein spring assembly 150 is slidably centered for axial endwise movements in response to loads or impacts being exerted axially against the draft gear assembly 100. Preferably, each elastomeric pad 160 has two spaced and generally planar surfaces 162 and 164. As shown in FIG. 13, the planar surface 162 of any two axially adjacent pads 160 abuts with and is pressed against the planar surface 164 of an axially adjacent pad 160. Plate 153 preferably has a generally rectangular configuration which allows it to freely move within the chamber 115 in the same direction as do the springs 152 in response to an axial load being placed on the spring assembly 150.

Preferably, each elastomeric pad 160 and, thereby each spring 152, is configured such that its radial expansion, in response to impacts or loads being placed thereon, is limited by the walls of housing 109 thereby enhancing the absorption capabilities of spring assembly 150. Turning again to FIG. 12, each pad 160 is preferably configured such that the radial or outward expansion of the pad 160 will be limited by the housing walls 109 and 109' before the pad expands to engage housing walls 107 and 107'. In a preferred embodiment, and during operation of the draft gear assembly 100, and especially those pads 160 disposed closer to the spring seat 140, will radially expand in response to an impact load being placed thereon, to such an extent as they positively engage and/or contact against the inner surface of the housing walls 109 and 109' whereby enhancing the absorption capabilities of those pads 160 of the spring assembly 150 disposed closest to the spring seat 140. In one form of this invention disclosure, the pads 160 are maintained in general axial alignment with each other and relative to the longitudinal axis 108 during operation of the draft gear assembly 100 by an elongated guide rod 162 (FIG. 12).

Preferably, each elastomeric pad 160 is formed from a polyester material having a Shore D durometer hardness ranging between about 40 and 60 and an elastic strain to plastic strain ratio of about 1.5 to 1. The working process and methodology for creating each spring unit 152 involves creating a preform block which is precompressed to greater than 30% of the preformed height of the preform thereby transmuting the preform into an elastomeric spring.

In one embodiment of this invention disclosure, the durometer hardness of the individual springs 152 comprising spring assembly 150 can differ relative to each other. That is, the cumulative durometer hardness of the springs 152 disposed between spring seat 140 and plate 153 can differ from the cumulative durometer hardness of the springs 152 disposed between housing end wall 110 and plate 153. As mentioned, however, it is preferable for the cumulative durometer hardness of the springs 152 between the housing end wall 110 and plate 153 to be greater or harder than the cumulative durometer hardness of the springs 152 between spring seat 140 and plate 153. Such design allows the functionality and performance characteristics of draft gear assembly 100 to be "fine tuned" to the particular environment wherein the energy absorption/cushioning assembly 20 on each railcar 10 will be used and function.

As shown in FIGS. 11, 12 and 13, a relatively large rectangular opening 170 is preferably formed in wall 107 of the draft gear housing 106. Opening 170 is sized such that one or more of the spring units 152 and plate 153 can be inserted through the opening 170 in a direction extending generally normal to the longitudinal axis 108 of the draft gear assembly 100 and into the hollow chamber 115 of housing 106. Housing wall 107' may also be provided with an opening 172. Preferably, the peripheral margin 174 of opening 172 defines a smaller area than the margin 173 of opening 170.

Figure 16:
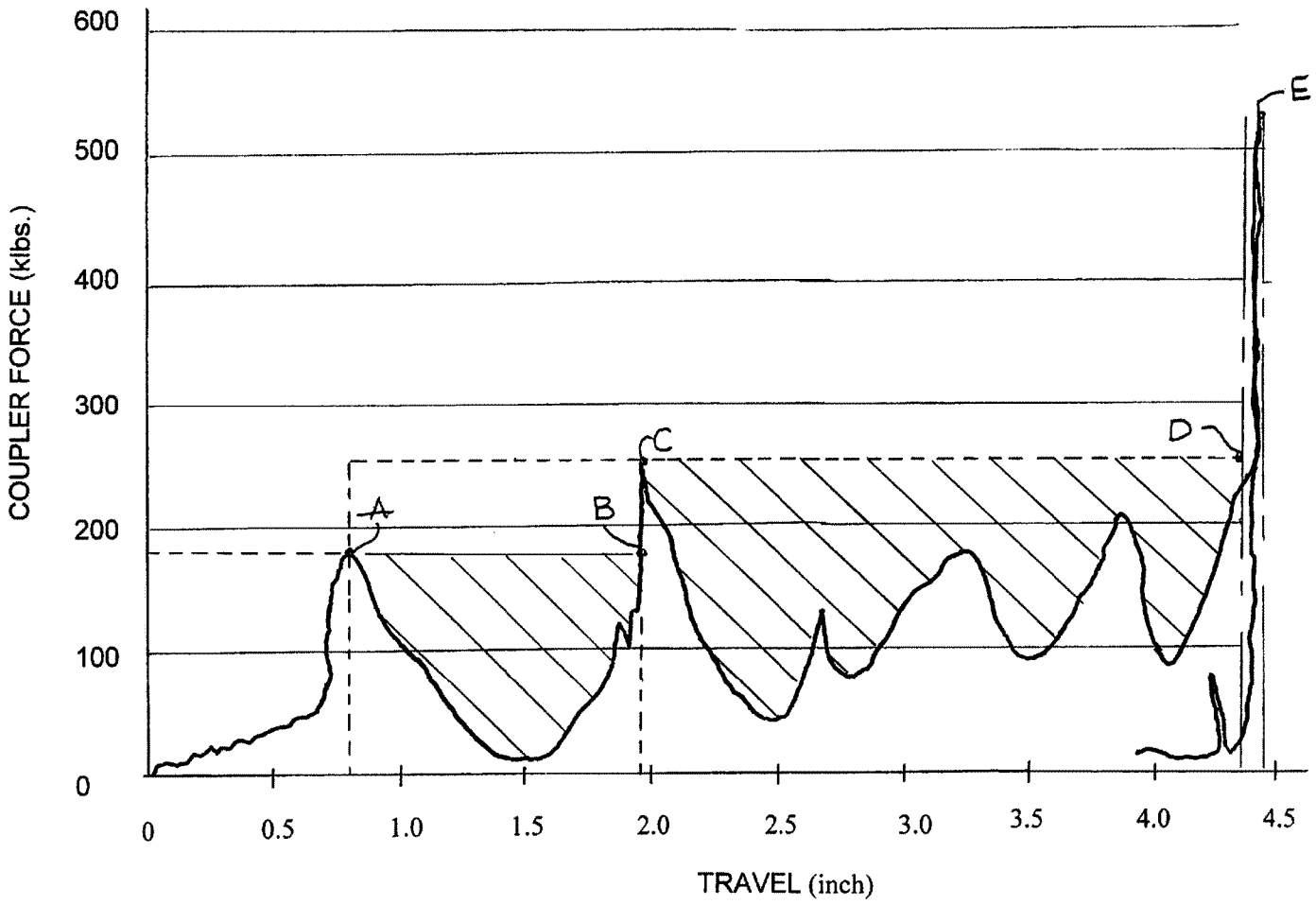
FIG. 16 is a is a schematic graphical representation of the forces realized by a conventional draft gear assembly.
Figure 17:
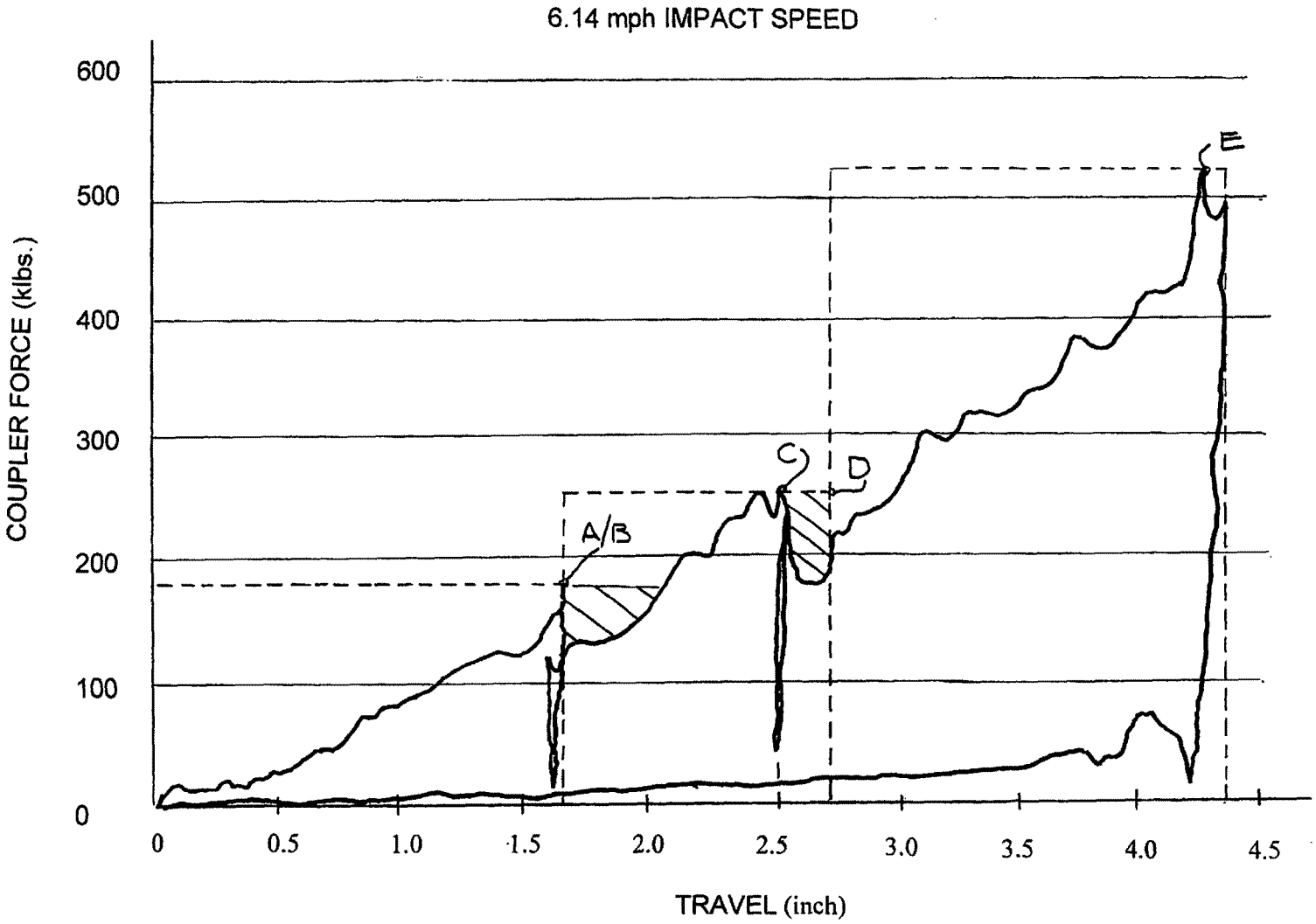
FIG. 17 is a schematic graphical representation of the forces realized by a draft gear assembly having a spring assembly embodying some of the principals and teachings of this invention disclosure.

As mentioned above, the purpose of the rigid separator plate 153 between the springs 152 is to provide the springs 152 with different dynamic elastic absorption characteristics on opposite sides of the plate 153 so as to optimize dynamic lost work opportunities during an impact event of the draft gear assembly 100. FIG. 16 is a schematic graphical representation of the forces realized by a conventional friction/elastomeric draft gear assembly. Whereas, FIG. 17 is a schematic graphical representation of the forces realized by a draft gear assembly embodying a spring assembly 150 as described above and configured with a separator plate 153 between the opposed ends thereof. A comparison between FIGS. 16 and 17 quickly and readily reveals how the spring assembly 150 configured with a separator plate 153 disposed between opposed ends of the spring assembly 150 minimizes the dynamic lost work opportunities during an impact event of the draft gear assembly 100.

As used herein and throughout, the phrase "lost work opportunity" means and refers to where coupler force levels on the draft gear assembly drop-off or fall off dramatically over a given travel. The areas shown in dash lines in FIG. 16 between points A-B and C-D represent lost work opportunities for a conventional draft gear assembly. FIG. 17 schematically represents the coupler force levels for a given travel of a draft gear assembly embodying principals and teachings of the present invention disclosure. The points A, B, C, D and E in FIG. 17 are similar to the coupler force levels for a given travel schematically represented at points A, B, C, D and E in FIG. 16. The coupler force levels for a given travel shown in FIG. 16 as compared to the coupler force levels for a given travel shown in FIG. 17 shows how the a draft gear assembly embodying those features and teachings of the present invention disclosure minimizes the lost work opportunities during an impact event on the draft gear assembly 100. In the embodiment shown by way of example in FIG. 17, the distance between points D and E schematically represent additional work opportunities provided by a draft gear assembly embodying the teachings and principals of this invention disclosure.

Figure 18:
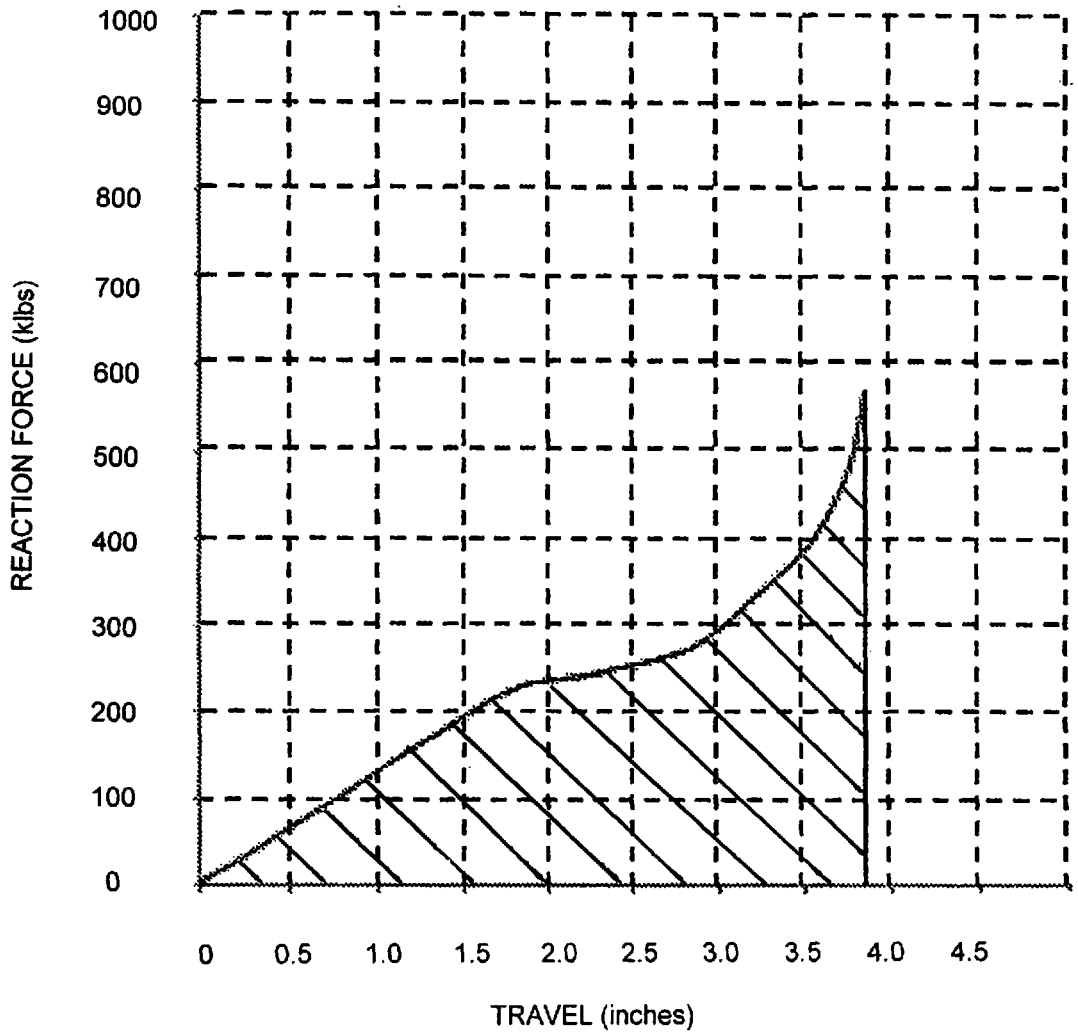
FIG. 18 is a schematic representation of the performance of one form of draft gear assembly embodying principals and teachings of this invention disclosure.

FIG. 18 schematically represents the performance of an energy absorption/coupling system 20 of this invention disclosure embodied with a coupler 60 as described above capable of moving at least 4.5 inches, and the draft gear assembly 100 is designed as shown in FIG. 15, with the spring assembly 150 being configured to function in combination with the angles θ and β of the first and second friction sliding surfaces 129 and 139, respectively, relative to the longitudinal axis 108 the draft gear assembly 100 consistently and repeatedly withstands about 70,000 ft-lbs. of energy imparted thereto at a force level not exceeding a force level of about 600,000 lbs. over a range of travel of the wedge member 130 in an inward axial or longitudinal direction relative to the draft gear housing 106 of about 3.9 inches.

Figure 19:
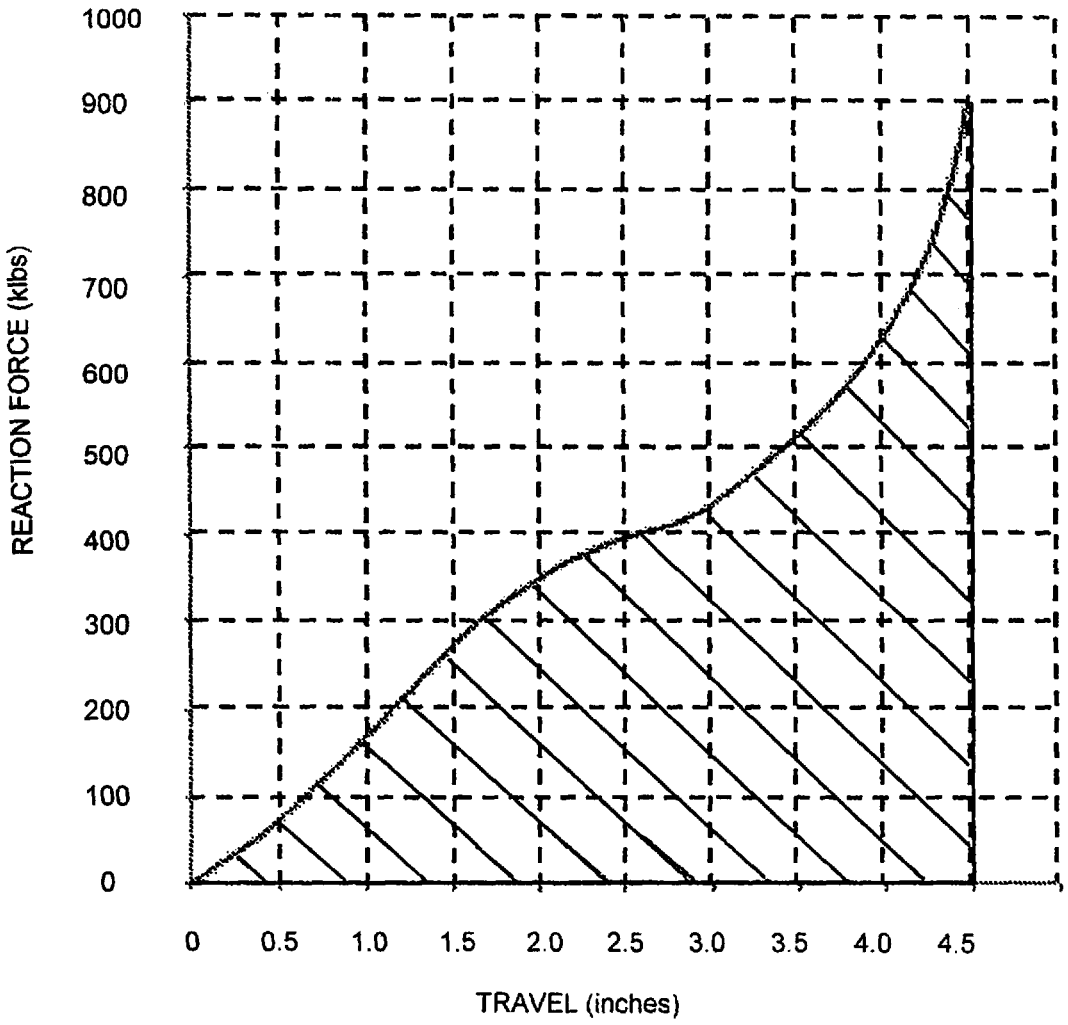
FIG. 19 is a schematic representation of the performance of another form of draft gear assembly embodying principals and teachings of this invention disclosure.

Alternatively, and as shown in FIG. 19, with the spring assembly 150 of the draft gear assembly 100 is configured to function in operable combination with the angles θ and β of the first and second friction sliding surfaces 129 and 139, respectively, relative to the longitudinal axis 108 such that the draft gear assembly 100 consistently and repeatedly withstands about 110,000 ft-lbs. of energy imparted thereto at a force level not to exceed 900,000 lbs. over a range of travel of the wedge member 130 in an inward axial direction relative to the draft gear housing 106 not exceeding 4.5 inches Suffice it to say, the spring assembly 150 of the draft gear assembly 100 is configured to function in operable combination with the angles θ and β of the first and second friction sliding surfaces 129 and 139, respectively, relative to the longitudinal axis 108 the draft gear assembly such that the draft gear assembly can consistently and repeatedly withstand about 75,000 ft-lbs. to about 110,000 ft-lbs. Of energy imparted thereto while not exceeding a force level of about 900,000 lbs. over a range of travel of the wedge member 130 in an inward axial direction relative to the draft gear housing 106 not exceeding 4.5 inches.

With the present invention disclosure, and with no design changes to the centersill 14 on railcar 10, the coupler 60 associated with each draft assembly 40 on railcar 10 has been configured such that it can achieve a range of longitudinal or horizontal movement in one axial direction of between about 4.5 inches. This gain in longitudinal movement of the coupler 60 is then utilized by the draft gear assembly 100. That is, with the present disclosure, and with no design changes to the centersill 14 on railcar 10, the draft gear assembly 100 uses such increase in travel of the coupler 60 to consistently and repeatedly withstand between about 70,000 ft-lbs. and about 110,000 ft-lbs. of energy imparted thereto at a force level not exceeding 900,000 lbs. over a range of travel of the wedge member 130 in an inward axial direction relative to the draft gear housing 106 not exceeding 4.5 inches.

The present invention disclosure also involves a method for coupling two railcars to each other. The method includes the steps of: providing each railcar with a pair of draft assemblies 40 toward opposed ends of the railcar 10 and which operate in unison relative to each other so as to provide a cumulative longitudinal travel greater than 8.5 inches over which energy imparted to the railcar 10 is to be absorbed while maintaining an overall length of the railcar constant. Each draft assembly 40 includes a coupler 60 and a draft gear assembly 100 arranged in longitudinal and operable relation relative to each other. Each coupler 60 has a head portion 64 extending longitudinally from a shank portion 66. The head portion 64 of the coupler 60 includes: a knuckle 74 for releasably connecting the coupler 60 to a second railcar coupler 60' of an adjacent railcar 10', a nose end 69 and a gathering face 76 extending from the nose end 69 for engaging a knuckle 40' of the second railcar coupler 60' on the adjacent railcar 10'. The coupler 60 is configured to allow for at least 4.5 inches of travel in a single longitudinal direction during operation of the coupler 60.

The draft gear assembly 100 of each draft assembly 40 preferably has a hollow metal housing 106 open at a first end 114 and closed toward the second end 112 thereof. The housing 106 is configured to fit within the standard sized (24.625 inch) pocket 30 defined by the centersill 14 on the railcar 10. Housing 106 defines a series of tapered longitudinally extended inner surfaces 116 opening to and extending from the first end 114 of the housing. A series of friction members 122 are equally spaced about a longitudinal axis 108 of the housing 106 toward the first end 114 of the housing 106. Each friction member 122 has axially spaced first and second ends 124 and 126, respectively, and an outer surface 128 extending between the ends 124, 126. The outer surface 128 on each friction member 122 is operably associated with one of the tapered longitudinally extended inner surfaces 116 on the housing 106 so as to define a first angled friction sliding surface 129 therebetween.

A wedge member 130 is arranged for axial movements relative to the first end 114 of the housing 106. Wedge member 130 defines a series of outer tapered surfaces 137 equally spaced about the longitudinal axis 108 of the housing 106 and equal in number to the number of friction members 122. Each outer tapered surface 137 on the wedge member 130 is operably associated with an inner surface 127 on each friction member 122 so as to define a second angled friction sliding surface 139 therebetween. As the wedge member 130 moves axially inward relative to the housing 106, wedge member 130 provides a radially directed force against the friction members 122 whereby increasing the friction between the friction members 122 and housing 106.

A spring seat 140 is arranged within housing 106. One surface 142 of the spring seat 140 is arranged in operable engagement with the second end 126 of each friction member 122 A spring assembly 150 is disposed between the closed end 112 of housing 106 and a second surface 144 of spring seat 140. The purpose of the spring assembly 150 is to for store, dissipate and return energy imparted to the draft gear assembly 100 by the coupler 60. The draft gear assembly 100 of each draft assembly 40 is preferably configured to consistently and repeatedly withstand up to about 110,000 ft-lbs. of energy imparted to the draft gear assembly 100 at a force level not exceeding 900,000 lbs. over a range of travel of the coupler in an inward axial direction relative to the centersill approximating 4.5 inches. The methodology further involves the step of: configuring the head portion 64 of the coupler 60 such that a longitudinal distance of about 10.75 inches separates the back surface 80 of the head portion 64 from the nose end 69. Preferably, the coupler head portion 64 is configured with a locklifter shelf 84 disposed about 1.875 inches above a bottom edge 86 of the coupler 60. The preferred methodology further involves the step of: configuring the shank portion 66 of the coupler 60 with a closed ended slot 88 having a longitudinal length of about 8 inches.

The incorporation and embodiment of an energy absorption/coupling system of the type described above, allows the draft assembly 40 at each end of the railcar 10 to performs in a manner heretofore unknown in the prior art. More specifically, the incorporation and embodiment of the an energy absorbing/coupling system of the type described above into each draft assembly 40 of the railcar 10 allows for increased travel over which the energy from impact loads of colliding railcars can be absorbed, dissipated and returned while maintaining the overall length of the railcar generally constant. As such, the incorporation and embodiment of an energy absorption/coupling system of the type described above, into each draft assembly 40 on the car 10 protects the integrity of the freight car due to excessive longitudinal loads being placed thereon, especially as the cars are being coupled to each other even if such longitudinal loads should exceed the design loads set by the AAR.

Notably, the configuration of the energy absorption/coupling system of the present invention: 1) requires no change to existing centersill designs; 2) offers a significant increase in distance over which the energy between two colliding cars can be absorbed; and 3) advantageously accomplishes the above while advantageously maintaining the overall length of the railcar constant. As such, the embodiment and incorporation of the present invention disclosure into a railcar does not affect passing sidings and loading facilitates which often limit the number of railcars that can be joined to each other in one train while offering significantly improved performance with no loss in train efficiency.

From the foregoing, it will be observed that numerous modifications and variations can be made and effected without departing or detracting from the true spirit and novel concept of this invention disclosure. Moreover, it will be appreciated, the present disclosure is intended to set forth exemplifications which are not intended to limit the disclosure to the specific embodiments illustrated. Rather, this disclosure is intended to cover by the appended claims all such modifications and variations as fall within the spirit and scope of the claims.

What is claimed is:

1. An energy absorbing/coupling system for a railcar having a centersill, said energy absorbing/coupling system comprising:

a draft assembly provided toward opposed ends of the centersill, with each draft assembly including a coupler and a draft gear assembly disposed in longitudinally disposed and operable relation relative to each other;

with the coupler having a longitudinal axis and includes a head portion extending longitudinally from a shank portion, with the head portion of the coupler longitudinally extending from an end of the centersill and includes: a knuckle for releasably connecting the coupler to a second railcar coupler on an adjacent railcar, a gathering face extending from a nose end toward the shank portion for engaging a knuckle of the second railcar coupler on the adjacent railcar, and wherein the head portion further includes a horn portion having a back surface extending generally transverse to the longitudinal axis of the coupler and longitudinally spaced from the nose end such that the coupler is permitted at least 4.5 inches of travel in a single longitudinal direction during operation of the coupler, and wherein the shank portion guides the coupler for endwise longitudinal movements relative to the centersill;

wherein the draft gear assembly includes: a hollow metal housing open at a first end and closed toward the second end thereof, with the housing being configured to fit within the pocket defined by the centersill on the railcar, with the housing defining a series of tapered longitudinally extended inner surfaces opening to and extending from the first end of the housing, a series of friction members equally spaced about a longitudinal axis of the draft gear assembly toward the first end of the housing, with each friction member having axially spaced first and second ends and an outer surface extending between the ends, with the outer surface on each friction member being operably associated with one of the tapered longitudinally extended inner surfaces on the housing so as to define a first angled friction sliding surface therebetween, a wedge member arranged for axial movement relative to the first end of the housing and to which the shank of the coupler applies an external force during operation of the railcar, with the wedge member defining a series of outer tapered surfaces equally spaced about the longitudinal axis of the housing, with each outer tapered surface on the wedge member being operably associated with an inner surface on each friction member so as to define a second angled friction sliding surface therebetween and such that the wedge member produces a radially directed force against the friction members upon movement of the wedge member inwardly of the housing, a spring seat arranged within the housing, with one surface of the spring seat being arranged in operable engagement with the second end of each friction member, a spring assembly disposed in the housing between the closed end of the housing and a second surface of the spring seat for storing, dissipating and returning energy imparted to the draft gear assembly by the coupler, with the spring assembly comprising an axial stack of individual elastomeric springs, and wherein the spring assembly is configured to function in operable combination with the disposition of the first and second angled sliding surfaces relative to the longitudinal axis of the draft gear assembly such that said draft gear assembly consistently and repeatedly withstands about 70,000 ft-lbs. to about 85,000 ft-lbs. of energy imparted to the draft gear assembly while not exceeding a force level of about 600,000 lbs. over a range of travel of the wedge member in an inward axial direction relative to the housing greater than 3.5 inches; and the spring assembly of the draft gear assembly further includes a rigid separator plate disposed between two individual and axially adjacent springs in the axial stack of elastomeric springs so as to create different dynamic elastic absorption characteristics on opposite sides of the separator plate whereby optimizing dynamic lost work opportunities during an impact event of the draft gear assembly.

2. The energy absorbing/coupling system for a railcar according to claim 1, wherein a distance of approximately 10.75 inches separates the back surface of the horn portion from the nose end on the head portion.

3. The energy absorbing/coupling system for a railcar according to claim 1, wherein the coupler head portion further includes a locklifter shelf disposed less than 2.0 inches above a bottom edge of the coupler.

4. The energy absorbing/coupling system for a railcar according to claim 1, wherein the shank portion defines a key slot having a length greater than approximately 8 inches.

5. The energy absorbing/coupling system for a railcar according to claim 1, wherein the first angled friction sliding surface of the draft gear assembly is disposed at an angle ranging between about 1.5 degrees and about 5 degrees relative to the longitudinal axis of the draft gear assembly.

6. The energy absorbing/coupling system for a railcar according to claim 1, wherein the second angled friction sliding surface of the draft gear assembly is disposed at an angle ranging between about 32 degrees and about 45 degrees relative to the longitudinal axis of the draft gear assembly.

7. The energy absorbing/coupling system for a railcar according to claim 1, wherein the elastomeric pad of each individual elastomeric spring has a Shore D hardness ranging between about 40 and 60.

8. An energy absorbing/coupling system for a railcar having a centersill defining a pocket, the energy absorbing/coupling system comprising:

a draft assembly provided toward opposed ends of the centersill, with each draft assembly including a coupler and a draft gear assembly disposed in longitudinally disposed and operable relation relative to each other;

with the coupler including a head portion extending longitudinally from a shank portion, with the head portion of the coupler longitudinally extending from an end of the centersill and includes: a knuckle for releasably connecting the coupler to a second railcar coupler on an adjacent railcar, a gathering face extending from a nose end for engaging a knuckle of the second railcar coupler on the adjacent railcar, a guard arm portion longitudinally extending from the nose end toward the shank portion, and wherein the head portion further includes a horn portion having a back surface, with the head portion of the coupler being structured to permit at least 4.5 inches of travel of the shank portion in a single longitudinal direction during operation of the coupler, and wherein the shank portion guides the coupler for endwise longitudinal movements relative to the centersill during operation of the coupler; and wherein the draft gear assembly includes: a hollow metal housing open at a first end and closed toward the second end thereof, with the housing being configured to fit within the pocket defined by the centersill on the railcar, with the housing defining a series of tapered longitudinally extended inner surfaces opening to and extending from the first end of the housing, a series of friction members equally spaced about a longitudinal axis of the housing toward the first end of the housing, with each friction member having axially spaced first and second ends and an outer surface extending between the ends, with the outer surface on each friction member being operably associated with one of the tapered longitudinally extended inner surfaces on the housing so as to define a first angled friction sliding surface therebetween, a wedge member arranged from for axial movement relative to the first end of the housing and to which the shank of the coupler applies an external force during operation of the railcar, with the wedge member defining a series of outer tapered surfaces equally spaced about the longitudinal axis of the housing, with each outer tapered surface on the wedge member being operably associated with an inner surface on each friction member so as to define a second angled friction sliding surface therebetween and such that the wedge member causes the friction member to move radially outward upon movement of the wedge member inwardly of the housing, a spring seat arranged within the housing, with one surface of the spring seat being arranged in operable engagement with the second end of each friction member, a spring assembly disposed in the housing between the closed end of the housing and a second surface of the spring seat for storing, dissipating and returning energy imparted to the draft gear assembly by the coupler, and wherein the draft gear assembly is configured to function in operable combination with the disposition of said first and second angled sliding surfaces of said draft gear assembly such that said draft gear assembly consistently and repeatedly withstands about 110,000 ft-lbs. of energy imparted to the draft gear assembly at a force level not to exceed 900,000 lbs. over a range of travel of the wedge member in an inward axial direction relative to the housing of at least 4.5 inches; and the spring assembly includes an axial stack of individual elastomeric springs, with each elastomeric spring including an elastomeric pad having a generally rectangular shape, in plan, approximating the cross-sectional configuration of the hollow chamber defined by the housing, the spring assembly further includes a rigid separator plate disposed between two individual and axially adjacent springs in the axial stack of elastomeric springs so as to create different dynamic elastic absorption characteristics on opposite sides of the separator plate whereby optimizing dynamic lost work opportunities during an impact event of the draft gear assembly.

9. The energy absorbing/coupling system for a railcar according to claim 8, wherein a distance ranging between about 10.75 inches and 11 inches separates the back surface of the horn portion from the nose end on the head portion.

10. The energy absorbing/coupling system for a railcar according to claim 8, wherein the coupler head portion further includes a locklifter shelf disposed approximately 2 inches above a bottom edge of the coupler.

11. The energy absorbing/coupling system for a railcar according to claim 8, wherein the shank portion of the coupler defines a closed ended key slot having a length greater than approximately 8 inches.

12. The energy absorbing/coupling system for a railcar according to claim 8, wherein the first angled friction sliding surface of said draft gear assembly is disposed at an angle ranging between about 1.5 degrees and about 5 degrees relative to the longitudinal axis of the draft gear assembly.

13. The energy absorbing/coupling system for a railcar according to claim 8, wherein the second angled friction sliding surface of said draft gear assembly is disposed at an angle ranging between about 32 degrees and about 45 degrees relative to the longitudinal axis of the draft gear assembly.

14. The energy absorbing/coupling system for a railcar according to claim 8, wherein the spring assembly of said draft gear assembly includes an axial stack of individual elastomeric springs, with each elastomeric spring including an elastomeric pad having a generally rectangular shape, in plan, approximating the cross-sectional configuration of the hollow chamber defined by the housing whereby optimizing the capability of the spring assembly to store, dissipate and return energy imparted to the draft gear assembly by the coupler.

15. The energy absorbing/coupling system for a railcar according to claim 14, wherein the elastomeric pad of each individual elastomeric spring has a Shore D hardness ranging between about 40 and 60.

16. The energy absorbing/coupling system for a railcar according to claim 14, wherein the spring assembly of said draft gear assembly further includes a rigid separator plate disposed between two individual and axially adjacent springs in said axial stack of elastomeric springs so as to create different dynamic elastic absorption responses on opposite sides of the separator plate whereby optimizing dynamic lost work opportunities during an impact event of the draft gear assembly.

17. An energy absorbing/coupling system for a railcar having a centersill defining a pocket, the energy absorbing/coupling system comprising:

a pair of draft assemblies provided toward the ends of the centersill so as to provide a cumulative longitudinal distance greater than 8.75 inches of travel over which energy imparted to the railcar is to be absorbed without having to change the overall length of the railcar, with each draft assembly including a coupler and a draft gear assembly disposed in longitudinally disposed and operable relation relative to each other;

with the coupler including a head portion extending longitudinally from a shank portion, with the head portion of the coupler longitudinally extending from an end of the centersill and includes: a knuckle for releasably connecting the coupler to a second railcar coupler of an adjacent railcar, a nose portion and a gathering face extending from the nose portion for engaging a knuckle of the second railcar coupler on the adjacent railcar, a guard arm portion longitudinally extending from the nose portion toward the shank portion, and wherein the coupler is configured to allow for at least 4.5 inches of travel in a single longitudinal direction during operation of the coupler;

wherein the draft gear assembly includes: a hollow metal housing open at a first end and closed toward the second end thereof, with the housing being configured to fit within the pocket defined by the centersill on the railcar, with the housing defining a series of tapered longitudinally extended inner surfaces opening to and extending from the first end of the housing, a series of friction members equally spaced about a longitudinal axis of the housing toward the first end of the housing, with each friction member having axially spaced first and second ends and an outer surface extending between the ends, with the outer surface on each friction member being operably associated with one of the tapered longitudinally extended inner surfaces on the housing so as to define a first angled friction sliding surface therebetween, a wedge member arranged for axial movement relative to the first end of the housing and to which the shank of the coupler applies an external force during operation of the railcar, with the wedge member defining a series of outer tapered surfaces equally spaced about the longitudinal axis of the housing, with each outer tapered surface on the wedge member being operably associated with an inner surface on each friction member so as to define a second angled friction sliding surface therebetween and such that the wedge member causes the friction member to move radially outward upon movement of the wedge member inwardly of the housing, a spring seat arranged within the housing, with one surface of the spring seat being arranged in operable engagement with the second end of each friction member, a spring assembly disposed in the housing between the closed end of the housing and a second surface of the spring seat for storing, dissipating and returning energy imparted to the draft gear assembly by the coupler, with the spring assembly comprising an axial stack of individual elastomeric springs configured to function in operable combination with the disposition of said first and second angled sliding surfaces of said draft gear assembly relative to the longitudinal axis of said draft gear assembly such that said spring assembly of each draft gear assembly operates in operable combination with the first and second angled surfaces on the draft gear assembly such that each draft gear assembly consistently and repeatedly withstands about 70,000 ft-lbs. to about 110,000 ft-lbs. of energy imparted thereto while not exceeding a force level of 900,000 lbs. over a range of travel of the coupler in an inward axial direction relative to the centersill of about 4.5 inches;

the spring assembly for the draft gear assembly includes an axial stack of individual elastomeric springs, with each elastomeric spring including an elastomeric pad having a generally rectangular shape, in plan, approximating the cross-sectional configuration of the hollow chamber defined by the housing whereby optimizing the capability of the spring assembly to store, dissipate and return energy imparted to the draft gear assembly by the coupler; and the spring assembly of the draft gear assembly further includes a rigid separator plate disposed between two individual axially adjacent springs in the axial stack of elastomeric springs so as to create different dynamic elastic absorption reaction on opposite sides of the separator plate whereby optimizing dynamic lost work opportunities during an impact event of the draft gear assembly.

18. The energy absorbing/coupling system for a railcar according to claim 17, wherein a distance ranging between about 10.75 inches and 11 inches separates the back surface of the horn portion from the nose end on the head portion of the coupler.

19. The energy absorbing/coupling system for a railcar according to claim 17, wherein the coupler head portion further includes a locklifter shelf disposed approximately 2 inches above a bottom edge of the coupler.

20. The energy absorbing/coupling system for a railcar according to claim 17, wherein the shank portion of the coupler defines a closed ended key slot having a length greater than approximately 8 inches.

21. The energy absorbing/coupling system for a railcar according to claim 17, wherein the first angled friction sliding surface on the draft gear assembly is disposed at an angle ranging between about 1.5 degrees and about 5 degrees relative to the longitudinal axis of the draft gear assembly.

22. The energy absorbing/coupling system for a railcar according to claim 17, wherein the second angled friction sliding surface on the draft gear assembly is disposed at an angle ranging between about 32 degrees and about 45 degrees relative to the longitudinal axis of the draft gear assembly.

23. The energy absorbing/coupling system for a railcar according to claim 17, wherein the elastomeric pad of each individual elastomeric spring has a Shore D hardness ranging between about 40 and 60.

* * * * *